US010892081B2

(12) United States Patent
Yoshikawa et al.

(10) Patent No.: US 10,892,081 B2
(45) Date of Patent: Jan. 12, 2021

(54) REACTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Kouhei Yoshikawa, Mie (JP); Kouji Nishi, Mie (JP); Takashi Takada, Mie (JP); Shintaro Nanbara, Mie (JP)

(73) Assignees: AutoNetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 508 days.

(21) Appl. No.: 15/757,111

(22) PCT Filed: Sep. 7, 2016

(86) PCT No.: PCT/JP2016/076288

§ 371 (c)(1),
(2) Date: Mar. 2, 2018

(87) PCT Pub. No.: WO2017/043523

PCT Pub. Date: Mar. 16, 2017

(65) Prior Publication Data

US 2018/0190421 A1 Jul. 5, 2018

(30) Foreign Application Priority Data

Sep. 11, 2015 (JP) ..... 2015-180197
Nov. 24, 2015 (JP) ..... 2015-229217

(51) Int. Cl.
*H01F 27/02* (2006.01)
*H01F 27/30* (2006.01)
(Continued)

(52) U.S. Cl.
CPC ..... *H01F 27/025* (2013.01); *H01F 27/266* (2013.01); *H01F 27/306* (2013.01);
(Continued)

(58) Field of Classification Search
USPC ..... 336/90, 65, 212, 221, 178, 210
See application file for complete search history.

(56) References Cited

U.S. PATENT DOCUMENTS 9,514,878 B2 * 12/2016 Nakatsu ..... H01F 27/306
2009/0108971 A1 * 4/2009 Okamoto ..... H01F 37/00 336/65

(Continued)

FOREIGN PATENT DOCUMENTS

JP 2011-060915 A 3/2011
JP 2013-004531 A 1/2013

(Continued)

OTHER PUBLICATIONS

Search Report for PCT/JP2016/076288, dated Dec. 6, 2016.

*Primary Examiner* — Elvin G Enad
*Assistant Examiner* — Kazi S Hossain
(74) *Attorney, Agent, or Firm* — Honigman LLP

(57) ABSTRACT

A reactor including: a coil that includes a winding portion; a magnetic core that includes an inner core portion that is located inside the winding portion and an outer core portion that is located outside the winding portion; an inner interposed member that is interposed between an inner surface of the winding portion and the inner core portion; and an end surface interposed member that is interposed between an end surface of the winding portion and the outer core portion. The inner interposed member is provided with first positioning portions that engage with the end surface interposed member and are located so as to respectively face a first pair of surfaces of the outer core portion to position the outer
(Continued)

core portion, the first pair of surfaces being composed of a pair of surfaces that face each other.

13 Claims, 12 Drawing Sheets

(51) Int. Cl.
*H01F 27/26* (2006.01)
*H01F 37/00* (2006.01)
*H01F 27/32* (2006.01)

(52) U.S. Cl.
CPC ..... *H01F 37/00* (2013.01); *H01F 27/02* (2013.01); *H01F 27/32* (2013.01)

(56) References Cited

U.S. PATENT DOCUMENTS

2013/0088317 A1* 4/2013 Tawara ..... H01F 27/306
336/212
2015/0365015 A1* 12/2015 Ito ..... H01F 37/00
363/131

FOREIGN PATENT DOCUMENTS

JP 2014-027087 A 2/2014
JP 2014-143332 A 8/2014
JP 2014-225545 A 12/2014

* cited by examiner

4: 4A, 4B
41 41s, 41u
52 52L, 52S

REACTOR

This application is the U.S. national stage of PCT/JP2016/076288 filed Sep. 7, 2016, which claims priority of Japanese Patent Application No. JP 2015-180197 filed Sep. 11, 2015 and Japanese Patent Application No. JP 2015-229217 filed Nov. 24, 2015.

TECHNICAL FIELD

The present invention relates to a reactor.

BACKGROUND

JP 2012-253384A discloses a reactor that is housed in a casing, the reactor including: a coil that is formed by winding a winding wire; a ring-shaped magnetic core on which the coil is disposed; a casing that houses a combined body that includes the coil and the magnetic core; an insulator that is interposed between the coil and the magnetic core; and a sealing resin that fills the casing. JP 2012-253384A discloses that an adhesive agent or an adhesive tape, for example, is used to integrate a plurality of core pieces that constitute the magnetic core into one piece, and integrate the core pieces and gap members into one piece.

SUMMARY

A reactor according to the present disclosure is a reactor comprising: a coil that includes a winding portion; a magnetic core that includes an inner core portion that is located inside the winding portion and an outer core portion that is located outside the winding portion; an inner interposed member that is interposed between an inner surface of the winding portion and the inner core portion; and an end surface interposed member that is interposed between an end surface of the winding portion and the outer core portion, wherein the inner interposed member is provided with first positioning portions that engage with the end surface interposed member and are located so as to respectively face a first pair of surfaces of the outer core portion to position the outer core portion, the first pair of surfaces being composed of a pair of surfaces that face each other.

DETAILED DESCRIPTION OF PREFERRED EMBODIMENTS

Figure 1:
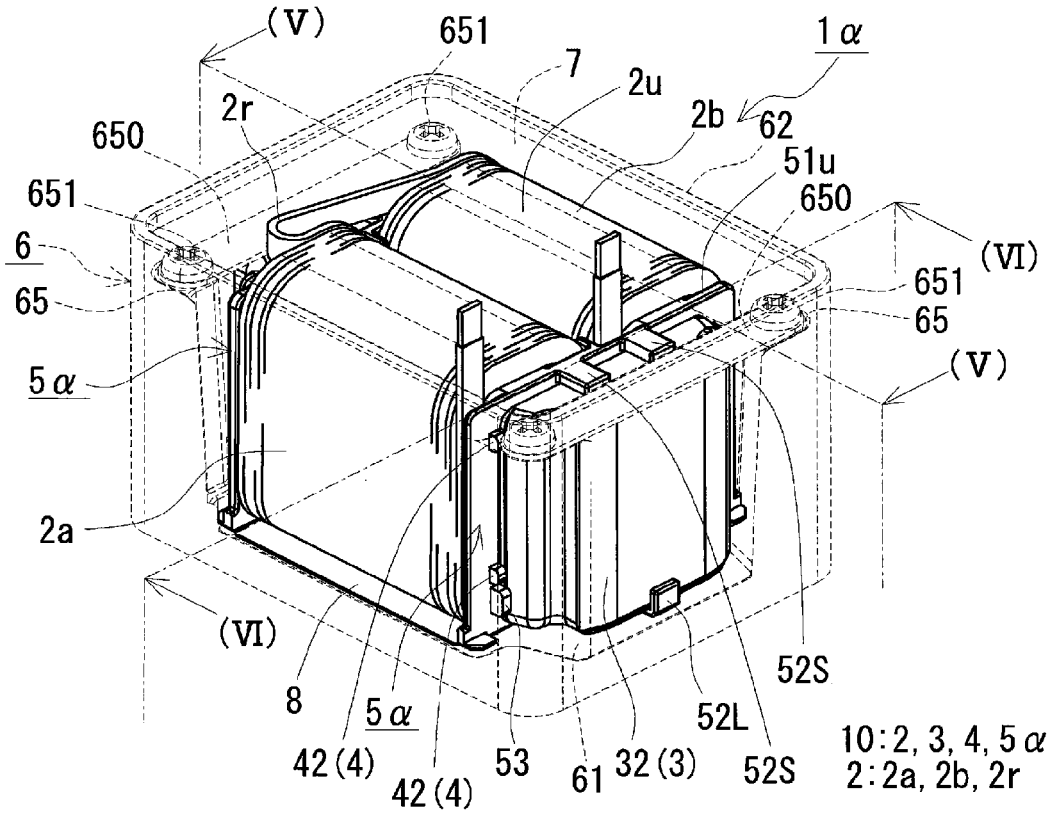
FIG. 1 is a schematic perspective view of a reactor according to a first embodiment.

Problems to be Solved by Present Disclosure

In recent years, as demand for hybrid vehicles and electric vehicles has increased, there is a desire to improve productivity when manufacturing reactors. In terms of such a demand, the process of manufacturing a reactor that is housed in a casing has room for improvement.

In the process of manufacturing a reactor, when forming a reactor by attaching a plurality of core pieces to a coil, high accuracy is required when positioning the core pieces relative to each other and when positioning the magnetic core and the coil relative to each other. Therefore, according to JP 2012-253384A, the core pieces and the gap members are fixed to each other in advance, using an adhesive tape or the like, so that the magnetic core and the coil are accurately positioned relative to each other. It is expected that productivity can be improved when manufacturing a reactor, by simplifying tasks involved in fixing constituent members to each other, such as the task of fixing the core pieces and the gap members to each other.

Therefore, one objective of the present invention is to provide a reactor that makes it easier to position constituent components thereof relative to each other during the manufacturing process thereof, and that achieves excellent productivity.

Advantageous Effects of Present Disclosure

The reactor according to the present disclosure makes it easier to position constituent components thereof relative to each other during the manufacturing process thereof, and achieves excellent productivity.

First, embodiments of the present invention will be listed and described.

A reactor according to an embodiment of the present invention is a reactor comprising: a coil that includes a winding portion; a magnetic core that includes an inner core portion that is located inside the winding portion and an outer core portion that is located outside the winding portion; an inner interposed member that is interposed between an inner surface of the winding portion and the inner core portion; and an end surface interposed member that is interposed between an end surface of the winding portion and the outer core portions, wherein the inner interposed member is provided with first positioning portions that engage with the end surface interposed member and are located so as to respectively face a first pair of surfaces of the outer core portion to position the outer core portion, the first pair of surfaces being composed of a pair of surfaces that face each other.

Regarding the outer core portion, for example, when a direction that matches the axial direction of the coil is defined as a front-rear direction, and directions that are orthogonal to the axial direction of the coil are defined as a left-right direction and a top-bottom direction, the first positioning portions position the outer core portion in either one of the left-right direction and the top-bottom direction, out of the three directions, namely the front-rear direction, the left-right direction, and the top-bottom direction. When the first pair of surfaces is a pair of surfaces that is composed of a left side surface of an outer core portion and a right side surface of an outer core portion, the first positioning portions are located so as to respectively face the left side surface and the right side surface of the outer core portions, and position the outer core portions in the left-right direction. When the first pair of surfaces is a pair of surfaces that is composed of a top surface and a bottom surface of an outer core portion, the first positioning portions are located so as to respectively face the upper surface and the lower surface of the outer core portion, and position the outer core portions in the top-bottom direction.

With the above-described configuration, the first positioning portions engage with the end surface interposed member, and position a pair of surfaces of the outer core portion, the pair of surfaces facing each other. Therefore, it is possible to integrate the inner interposed member and the end surface interposed member into one piece, and position the outer core portion in one of the left-right direction and the top-bottom direction out of the three directions, namely the front-rear direction, the left-right direction, and the top-bottom direction. It is easy to position the outer core portion in one of the left-right direction and the top-bottom direction by engaging the first positioning portions of the inner interposed member with the end surface interposed member and attaching the outer core portion to the end surface interposed member. Therefore, with the above-described configuration, even if the outer core portion does not have a portion that can be fitted to the end surface interposed member, for example, even if the inner core portion-side inner end surface of the outer core portion is a uniformly flat surface, it is possible to position the outer core portion in one of the left-right direction and the top-bottom direction, and it is possible to flexibly modify the shape of the outer core portion.

The above-described configuration also contributes to positioning of the inner core portion and the outer core portion. The inner interposed member is interposed between the winding portion and the inner core portion, and thus positioning to a certain level of accuracy is achieved. Therefore, as a result of positioning the inner interposed member and the outer core portion using the first positioning portions, it is possible to position the inner core portion and the outer core portion at a certain level of accuracy. Therefore, it is unnecessary to use an adhesive tape or the like to fix and position the inner core portion and the outer core portion. Thus, it is possible to achieve excellent workability when assembling the reactor, which leads to excellent productivity.

As an example of the above-described reactor, it is possible to employ an embodiment in which the end surface interposed member is provided with second positioning portions that protrude toward the outer core portion and are located so as to respectively face a second pair of surfaces of the outer core portion to position the outer core portion, the second pair of surfaces being composed of a pair of surfaces that intersect the first pair of surfaces.

With the above-described configuration, it is possible to position the outer core portion in two directions, namely the left-right direction and the top-bottom direction, out of the three directions. If the outer core portion has been positioned in the left-right direction using the first positioning portions, the outer core portion can be positioned in the top-bottom direction using the second positioning portions, and if the outer core portion has been positioned in the top-bottom direction using the first positioning portions, the outer core portion can be positioned in the left-right direction using the second positioning portions. By positioning the outer core portion in the two directions, namely the left-right direction and the top-bottom direction, using the first positioning portions and the second positioning portions, it is possible to more accurately position the outer core portion.

Since the end surface interposed member is provided with the second positioning portions, it is possible to more accurately position the constituent members of the reactor compared to cases in which the inner interposed member is provided with both the first positioning portions and the second positioning portions. This is because the inner interposed member can engage with the end surface interposed member and the outer core portion, and the end surface interposed member can engage with the inner interposed member and the outer core portion. Specifically, the first positioning portions of the inner interposed member position the outer core portion in one of the left-right direction and the top-bottom direction, and position the end surface interposed member by engaging with the end surface interposed member, and the second positioning portions of the end surface interposed member position the outer core portion in the other of the left-right direction and the top-bottom direction.

As an example of the above-described reactor provided with the second positioning portions, it is possible to employ an embodiment in which the second positioning portions include an L-shaped piece whose protruding end portion is bent, and that faces a surface of the outer core portion, the surface intersecting one of the second pair of surfaces of the outer core portion.

The expression "a protruding end portion of a second positioning portion is bent" means that, for example, when the left side surface of an outer core portion and the right side surface of an outer core portion (the first pair of surfaces) are positioned using the first positioning portions and the top and lower surfaces (the second pair of surfaces) of an outer core portion are positioned using the second positioning portions, an end portion in the front-rear direction of the outer core portion is bent. That is, the L-shaped piece is located so as to face an outer end surface of the outer core portion in the front-rear direction in addition to one of the second pair of surfaces of the outer core portion. Since the second positioning portions include the L-shaped piece, it is possible to position the outer core portion in the three directions (the left-right direction, the top-bottom direction, and the front-rear direction). By positioning the outer core portion in the three directions, namely the front-rear direction in addition to the left-right direction and the top-bottom direction, using the first positioning portions and the second positioning portions, it is possible to more accurately position the outer core portion.

As an example of the above-described reactor, it is possible to employ an embodiment in which the end surface interposed member is provided with an abutting portion that protrudes toward the outer core portion and abuts against one of the first pair of surfaces.

With the above-described configuration, the abutting portion abuts against one of the first pair of surfaces of the outer core portion, and thus the end surface interposed member can position the outer core portion in one direction at a certain level of accuracy even if the first positioning portions have not engaged with the end surface interposed member. Therefore, it is easier to engage the first positioning portions with the end surface interposed member so that the first positioning portions respectively face the first pair of surfaces of the outer core portions. Also, if the end surface interposed member is provided with the second positioning portions, and in particular, if the second positioning portions include the L-shaped piece, the abutting portion abuts against the outer core portion that is positioned by being moved to slide in a direction that is orthogonal to the direction in which the second positioning portions face each other. Therefore, it is easier to position the outer core portion relative to the end surface interposed member.

As an example of the above-described reactor, it is possible to employ an embodiment in which the outer core portion is present only at a position that is opposite to the winding portion with respect to the end surface interposed member.

Even if the outer core portion is present only at a position that is opposite to the winding portion with respect to the end surface interposed member, that is, even if the outer core portion does not have a portion that can be fitted to the end surface interposed member, it is possible to position the outer core portion in the left-right direction and the top-bottom direction using the first positioning portions and the second positioning portions.

As an example of the above-described reactor, it is possible to employ an embodiment that further includes a casing that houses a combined body that includes the coil, the magnetic core, the inner interposed member, and the end surface interposed member; and a sealing resin portion that fills the casing and seals the combined body.

The combined body is housed in the casing and is sealed using the sealing resin portion. Thus, it is possible to protect the combined body from the external environment (dust, corrosion, etc.), and to provide mechanical protection.

As an example of the above-described reactor provided with the casing and the sealing resin portion, it is possible to employ an embodiment in which the magnetic core includes a plurality of core pieces and gap members that are interposed between the core pieces, and the gap members are formed using a constituent resin of the sealing resin portion.

With the above-described configuration, when manufacturing the magnetic core during the manufacturing process, it is possible to form the gap members between the core pieces when forming the sealing resin portion, without separately preparing a gap material such as alumina. Therefore, it is possible to achieve excellent productivity.

As an example of the above-described reactor provided with the casing and the sealing resin portion, it is possible to employ an embodiment in which the end surface interposed member is provided with a leg that protrudes toward a bottom surface of the casing to support the combined body and keeps a distance between the casing and the outer core portion.

Since there is a gap between the outer core portion and the casing due to the presence of the leg, the outer core portion and the casing are prevented from coming into direct contact, and vibrations of the magnetic core including the outer core portion are prevented from being transmitted to the casing.

As an example of the above-described reactor provided with the casing and the sealing resin portion, it is possible to employ an embodiment in which the coil includes the winding portion that is provided as a pair of winding portions that are arranged side by side, and when an opening side of the casing that houses the combined body is defined as an upper side and a bottom surface side of the casing is defined as a lower side, the end surface interposed member is provided with an upper cutout that is located at an upper central position that corresponds to a gap between the pair of winding portions.

It is possible to fill the casing that houses the combined body with the constituent resin by inserting a tube, which serves as a feeding port of the constituent resin, into the gap between the combined body and the casing, placing the opening of the tube at a position near the bottom surface of the casing, and feeding the constituent resin from the lower side of the casing. The liquid level of the constituent resin fed into the casing rises from the lower side to the upper side of the casing. With the above-described configuration, the constituent resin flows by itself into the spaces in the winding portions and the gap between the pair of winding portions from the upper cutout upon the liquid level of the constituent resin reaching the level of the upper cutout. Therefore, it is possible to easily and reliably form the sealing resin portion. Thus, it is possible to reliably form the gap members using the constituent resin.

Also, with the above-described configuration, it is possible to prevent bubbles from being formed in the sealing resin portion formed in the spaces in the winding portions and the gap between the pair of winding portions. This is because, due to the presence of the upper cutout, the constituent resin flows into the gap between the pair of winding portions from an end portion side of the winding portions before the constituent resin flows into the gap between the winding portions so as to cover the winding portions from a side surface side of the winding portions. Since the constituent resin flows from an end portion side of the winding portions, the constituent resin fills the gap between the pair of winding portions while rising from the bottom surface side to the opening side of the casing. Therefore, air in the gap between the pair of winding portions is unlikely to be caught in the constituent resin. Thus, it is possible to efficiently fill the gap between the pair of winding portions with the constituent resin while preventing bubbles from being formed in the resin. By preventing bubbles from being formed in the sealing resin portion, it is also possible to prevent a failure such as degradation of the heat dissipation properties that may be caused by bubbles, the occurrence of a starting point of a crack, the occurrence of a source of vibrations, or degradation of magnetic properties.

Note that "the upper side" and "the lower side" in the present embodiment mean the upper side and the lower side when the casing is to be filled with the constituent resin, and do not necessarily coincide with the upper side and the lower side when the reactor has been actually installed. For example, when the bottom surface of the casing is placed on the upper side of a horizontal surface, the opening of the casing faces upward. When the bottom surface of the casing is placed on the lower side of a horizontal plane, the opening of the casing faces downward. When the bottom surface of the casing is placed on a vertical surface, the opening of the casing faces in a horizontal direction.

As an example of the above-described reactor in which the end surface interposed member is provided with the upper cutout, it is possible to employ an embodiment in which an uppermost surface of the end surface interposed member is flush with upper surfaces of the winding portions or protrudes further upward than the upper surfaces of the winding portions.

If the uppermost surface of the end surface interposed member (the upper surface of the end surface interposed member excluding the upper cutout portion) is flush with the upper surfaces of the winding portions or protrudes further upward than the upper surfaces of the winding portions, the constituent resin fed into the gap between the combined body and the casing is unlikely to flow into the gap between the pair of winding portions from an end surface side of the winding portions, and is likely to flow into the gap between the winding portions so as to cover the winding portions from a side surface side of the winding portions. Consequently, the constituent resin flows while air in the gap between the pair of winding portions is caught in the resin. Therefore, it is likely that bubbles are formed in the sealing resin portion formed between the pair of winding portions. Considering this problem, the end surface interposed member is provided with the upper cutout. As a result, upon the constituent resin reaching the lowermost surface of the upper cutout, the constituent resin flows into the gap between the pair of winding portions from the upper cutout, and thus the effects of the upper cutout can be easily achieved.

As an example of the above-described reactor in which the end surface interposed member is provided with the upper cutout, it is possible to employ an embodiment in which a lowermost surface of the upper cutout is flush with an upper surface of the outer core portion or is located at a position that is lower than the upper surface of the outer core portion.

If the lowermost surface of the upper cutout is flush with the upper surface of the outer core portion or is located at a position that is lower than the upper surface of the outer core portion, the liquid level of the constituent resin fed into the gap between the combined body and the casing rises from the lower side to the upper side of the casing, and upon the liquid level reaching the upper surface of the outer core portion, the constituent resin flows into the gap between the pair of winding portions. Therefore, it is possible to more quickly fill the gap between the pair of winding portions and spaces in the winding portions with the constituent resin.

As an example of the above-described reactor in which the end surface interposed member is provided with the upper cutout, it is possible to employ an embodiment in which the lowermost surface of the upper cutout includes a cutout inclined portion that is inclined downward in a direction from the outer core portion toward the winding portions.

Due to the lowermost surface of the upper cutout being provided with the cutout inclined portion, the constituent resin flows along the cutout inclined portion. Therefore, the constituent resin can easily flow into the gap between the pair of winding portions, and it is possible to more quickly fill the gap between the pair of the winding portions with the constituent resin.

As an example of the above-described reactor in which the upper cutout is provided with the cutout inclined portion, it is possible to employ an embodiment in which the end surface interposed member is provided with a partition portion that is located between the pair of winding portions, and an upper surface of the partition portion includes a partition inclined portion that is continuous with the cutout inclined portion.

If the end surface interposed member is provided with the partition portion, due to the upper surface of the partition portion being provided with the partition inclined portion, the constituent resin flows along the partition inclined portion as well as the cutout inclined portion. Therefore, the constituent resin can easily flow into the gap between the pair of winding portions, and it is possible to more quickly fill the gap between the pair of the winding portions with the constituent resin.

As an example of the above-described reactor provided with the casing and the sealing resin portion, it is possible to employ an embodiment in which the end surface interposed member is provided with an inner cutout that serves as a flow channel for an unsolidified constituent resin of the sealing resin portion when the sealing resin portion is to be formed along an inner peripheral edge of the end surface interposed member.

With the above-described configuration, upon the liquid level of the constituent resin reaching the inner cutout, the constituent resin flows by itself into the space in the winding portion from the inner cutout, and therefore it is possible to easily and reliably form the sealing resin portion in the space in the winding portion. Thus, it is possible to reliably form the gap members using the constituent resin.

Details of Embodiments of Present Invention

The following describes the details of embodiments of the present invention. Note that the present invention is not limited to these examples, and is specified by the scope of claims. All changes that come within the meaning and range of equivalency of the claims are intended to be embraced therein. Elements having the same name are denoted by the same reference signs throughout the drawings.

First Embodiment

A reactor 1α according to a first embodiment will be described with reference to FIGS. 1 to 6.

Reactor

Overall Configuration

Figure 2:
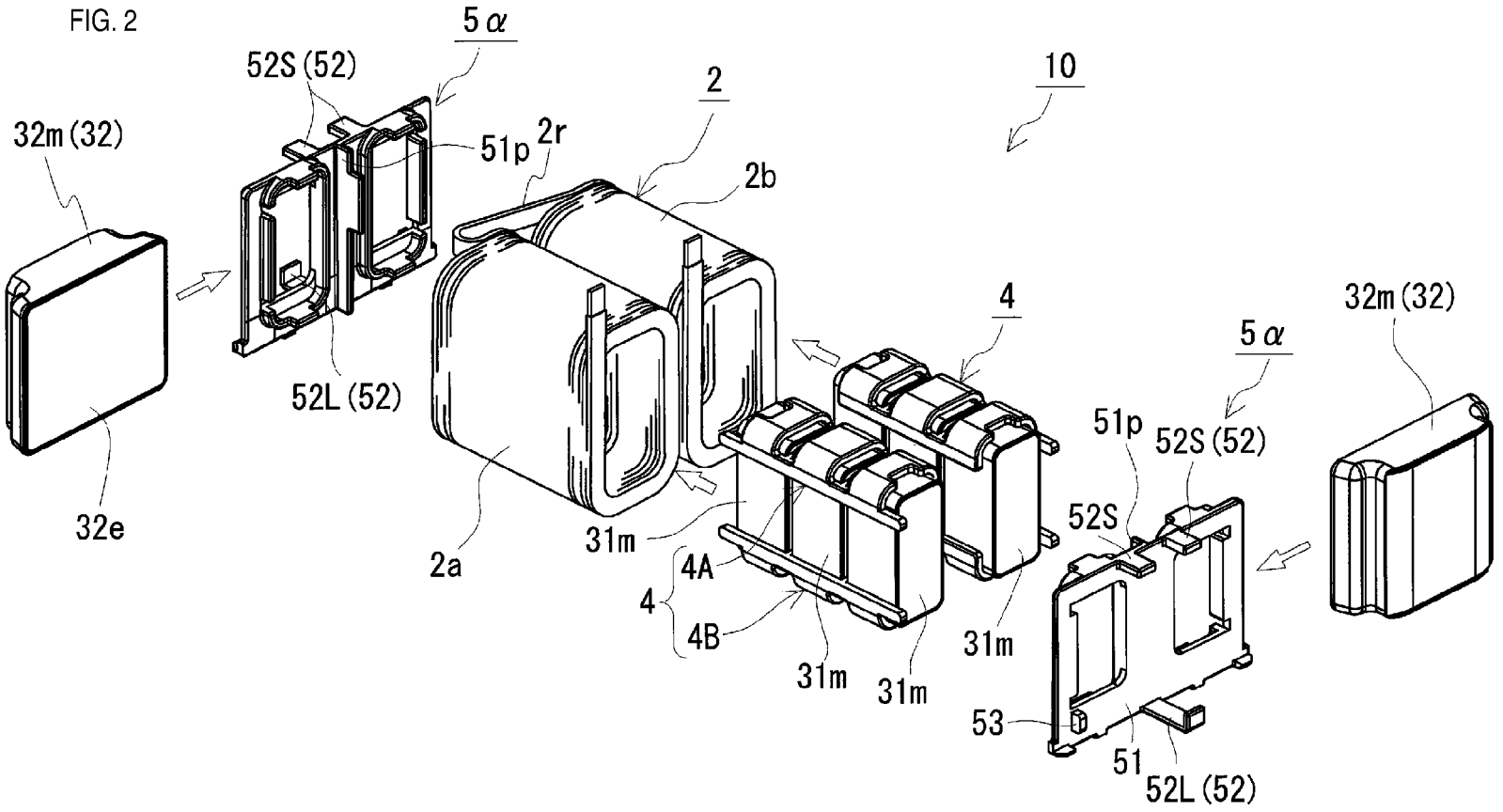
FIG. 2 is a schematic exploded perspective view of the reactor according to the first embodiment.
Figure 3:
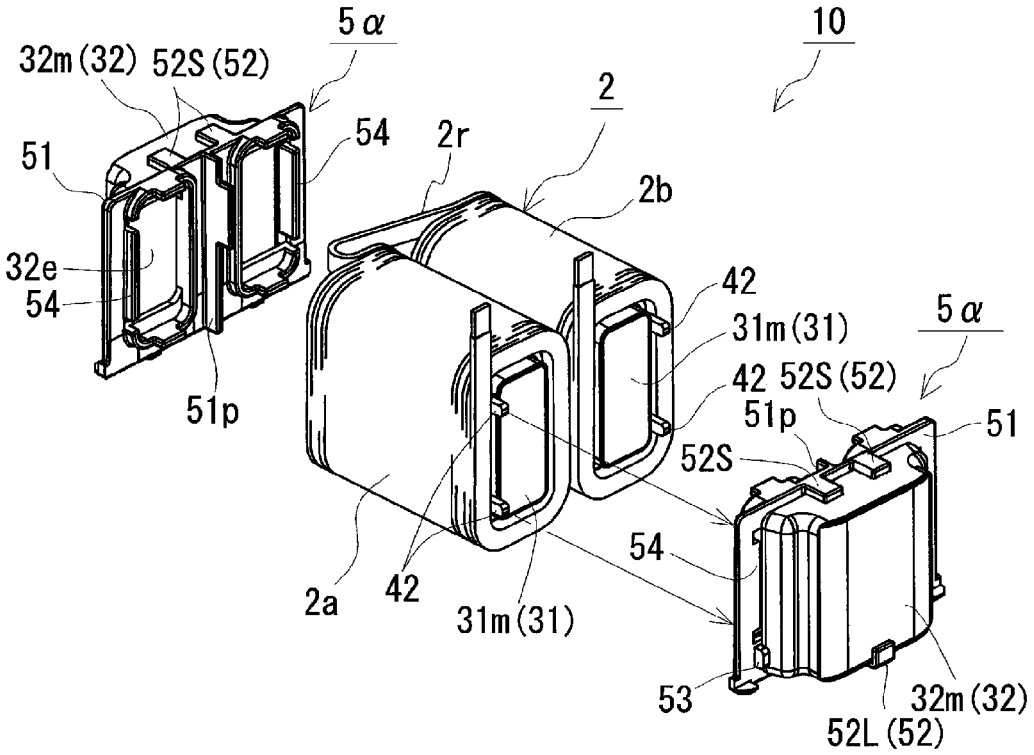
FIG. 3 is a schematic perspective view that illustrates a method for assembling the reactor according to the first embodiment.

As shown in FIGS. 1 to 3, the reactor 1α according to the first embodiment includes: a coil 2 that has winding portions 2*a* and 2*b* that are formed by winding a winding wire; a magnetic core 3 that includes inner core portions 31 that are located inside the winding portions 2*a* and 2*b* and outer core portions 32 that are located outside the winding portions 2*a* and 2*b*; and inner interposed members 4 and end surface interposed members 5α, which are interposed between the winding portions 2*a* and 2*b* and the magnetic core 3. The inner interposed members 4 are interposed between the inner surfaces of the winding portions 2*a* and 2*b* and the inner core portions 31. The end surface interposed members 5α are interposed between end surfaces of the winding portions 2*a* and 2*b* and the outer core portions 32.

A direction that matches the axial direction of the winding portions 2*a* and 2*b* is defined as a front-rear direction, a direction that is orthogonal to the axial direction of the winding portions 2*a* and 2*b* and in which the winding portions 2*a* and 2*b* are arranged side by side is defined as a left-right direction, and a direction that is orthogonal to the front-rear direction and the left-right direction is defined as a top-bottom direction. Then, a pair of surfaces of the outer core portions 32, which is composed of a left side surface and a right surface that face each other, is defined as a first pair of surfaces, and a pair of surfaces of the outer core portions 32, which is composed of an upper surface and a lower surface that face each other, is defined as a second pair of surfaces. One feature of the reactor 1α according to the first embodiment is that the inner interposed members 4 include first positioning portions (left-right positioning portions) 42 that engage with the end surface interposed members 5α and are located so as to face the left and right side surfaces of the outer core portions 32 to position the outer core portions 32 in the left-right direction. Another feature of the reactor 1α according to the first embodiment is that the end surface interposed members 5α include second positioning portions (top-bottom positioning portions) 52 that protrude toward the outer core portions 32 and are located so as to face the upper and lower surfaces of the outer core portions 32 to position the outer core portions 32 in the top-bottom direction.

The reactor 1α according to the first embodiment is provided with a casing 6 that houses a combined body 10 that includes the coil 2, the magnetic core 3, the inner interposed members 4, and the end surface interposed members 5α, and a sealing resin portion 7 that fills the casing 6 and seals the combined body 10. One feature of the reactor 1α according to the first embodiment is that the inner core portions 31 are constituted by a plurality of inner core pieces 31*m* and gap portions 31*g* that are located between the inner core pieces 31*m* and at the end surfaces, and the gap portions 31*g* are formed using the constituent resin of the sealing resin portion 7 (see FIG. 5).

The following describes each component in detail. In the following description, when the combined body 10 is housed in the casing 6, the opening side of the casing 6 is defined as the upper side and the bottom side (the installation side) of the casing 6 is defined as the lower side.

Coil

As shown in FIG. 2, the coil 2 includes: a pair of tubular winding portions 2*a* and 2*b* that are formed by spirally winding one continuous winding wire; and a coupling portion 2*r* that couples the winding portions 2*a* and 2*b* to each other. The winding portions 2*a* and 2*b* have a hollow tube shape as a result of winding the winding wire the same number of times in the same winding direction, and are arranged side by side (in the horizontal direction) such that their axial directions are parallel with each other. The coupling portion 2*r* is a portion that is bent in a U-like shape to connect the winding portions 2*a* and 2*b*. The coil 2 may be formed by spirally winding one winding wire that does not have a joint portion, or by manufacturing the winding portions 2*a* and 2*b* using separate winding wires and joining the end portions of the winding wires of the winding portions 2*a* and 2*b* to each other through welding or crimping. The two end portions of the coil 2 are drawn out of the winding portions 2*a* and 2*b* in appropriate directions, and are connected to a terminal member, which is not shown. An external device such as a power supply for supplying power to the coil 2 is connected via the terminal member.

The winding portions 2*a* and 2*b* in the present embodiment have a rectangular tube shape. The winding portions 2*a* and 2*b* that have a rectangular tube shape are winding portions whose end surfaces have a rectangular shape (including a square shape) and whose corners are rounded. Of course, the winding portions 2*a* and 2*b* may have a circular tube shape. The winding portions that have a circular tube shape are winding portions whose end surfaces have a closed surface shape (such as an oval shape, a perfect circle shape, or a race track shape).

The coil 2 that includes the winding portions 2*a* and 2*b* can be formed on the outer circumferential surface of a conductor such as a flat wire or a round wire that is made of a conductive material such as copper, aluminum, magnesium, or an alloy thereof, using a coated wire that includes an insulative coating that is made of an insulative material. In the present embodiment, the winding portions 2*a* and 2*b* are formed through edgewise-winding of a coated flat wire that includes a conductor that is made of a copper flat wire and an insulative coating that is made of enamel (typically polyamide imide).

In the coil 2, the distance between turns that are adjacent to each other, of the winding portions 2*a* and 2*b*, is smaller than or equal to 0.5 mm. The distance between turns mentioned above is the length of a space between turns that are adjacent to each other. Since the aforementioned distance between turns is smaller than or equal to 0.5 mm, the length of the winding portions 2*a* and 2*b* in the axial direction can be small, and the reactor 1α can be downsized. The aforementioned distance between turns is preferably smaller than or equal to 0.3 mm, and is particularly preferably smaller than or equal to 0.1 mm.

Magnetic Core

Figure 5:
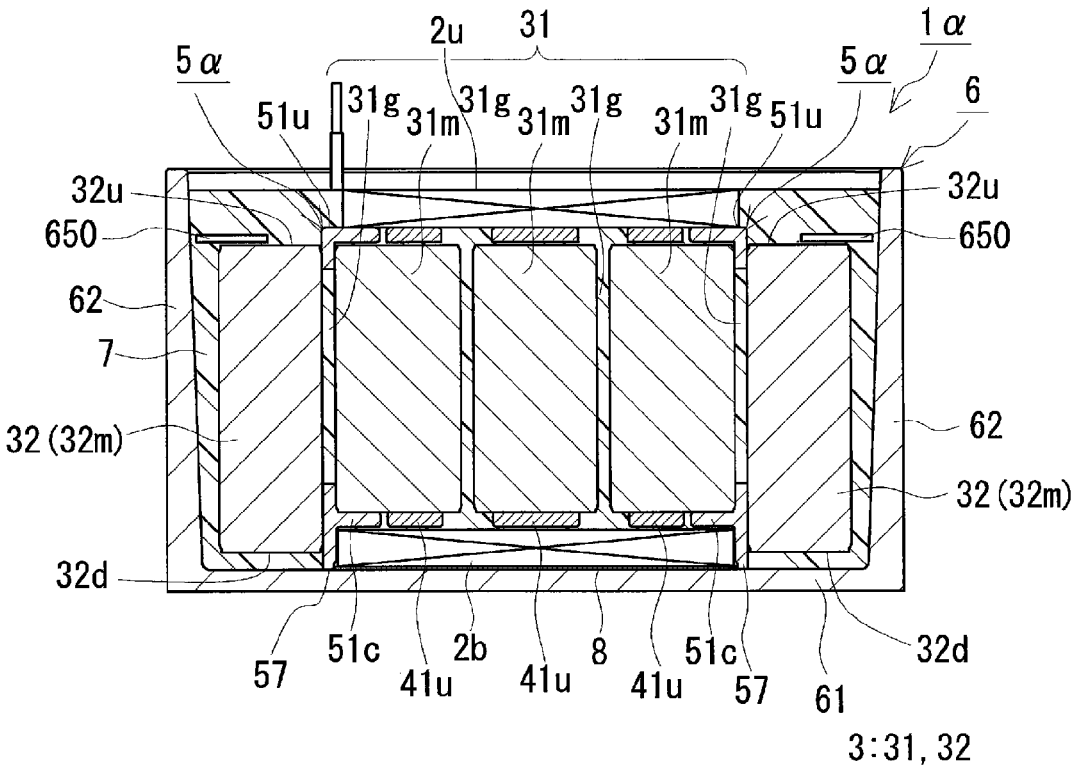
FIG. 5 is a cross-sectional view along (V)-(V) of the reactor shown in FIG. 1.

As shown in FIGS. 2 and 5, the magnetic core 3 includes the pair of inner core portions 31 that are located inside the winding portions 2*a* and 2*b*, and the pair of outer core portions 32 that are located outside the winding portions 2*a* and 2*b*. The pair of outer core portions 32 sandwich the pair of inner core portions 31 that are separated from each other, and bring the end surfaces of the inner core portions 31 and inner end surfaces 32*e* of the outer core portions 32 into contact with each other, so that the magnetic core 3 has a ring shape. In FIG. 2, gaps are respectively formed between the plurality of inner core pieces 31*m* that constitute the inner core portions 31. These gaps between the inner core pieces 31*m* are filled with the constituent resin of the sealing resin portion 7 described below, and thus gap portions 31*g* (FIG. 5) are formed. Also, in this example, the end surfaces of the inner core pieces 31*m* (gaps between the inner core pieces 31*m* and the outer core portions 32) are also filled with the constituent resin of the sealing resin portion 7, and thus gap portions 31*g* are formed. Due to this arrangement, the ring-shaped magnetic core 3 forms a closed magnetic path when the coil 2 is excited.

Inner Core Portions

The inner core portions 31 are columnar members whose outer shape matches the inner circumferential shape of the winding portions 2*a* and 2*b* (in this example, rectangular parallelepiped members whose corners are rounded). Each inner core portion 31 in this example is constituted by three inner core pieces 31*m*, gap portions 31*g* that are formed between the inner core pieces 31*m*, and gap portions 31*g* that are formed between the inner core pieces 31*m* and the outer core pieces 32*m* (the outer core portions 32) described below (see FIG. 5). Here, the inner core portions 31 are portions of the magnetic core 3, the portions being arranged in the axial direction of the winding portions 2*a* and 2*b*. For example, in FIG. 5, although the gap portions 31*g* at the two end portions of the inner core portions 31 are located outside the winding portions 2*a* and 2*b* relative to the end surfaces of the winding portions 2*a* and 2*b*, these gap portions 31*g* are included in the inner core portions 31. The gap portions 31*g* in this example are formed using the constituent resin of the sealing resin portion 7 described below.

Outer Core Portions

The outer core portions 32 are columnar members that connect end portions of the pair of inner core portions 31, and have the first pair of surfaces that is composed of a left side surface and a right side surface, and the second pair of surfaces that is composed of an upper surface and a lower surface. The outer core portions 32 in this example are constituted by the outer core pieces 32*m* whose upper surfaces 32*u* and lower surfaces 32*d* are substantially trapezoidal. One feature of the reactor 1α according to the first embodiment is that the outer core portions 32 are present only at positions that are opposite to the winding portions 2*a* and 2*b* with respect to the end surface interposed members 5α (see FIGS. 2 and 5). In this example, the inner end surfaces 32*e* of the outer core portions 32, which are inner core portion 31-side surfaces, are continuous and uniformly flat surfaces that do not have recesses, protrusions, steps, or ridges, and do not have portions that can be fitted to the end surface interposed members 5α. When the coil 2 and the magnetic core 3 are attached to each other, the lower surface of the coil 2 protrudes past the lower surfaces of the outer core portions 32. When the combined body 10 is housed in the casing 6 described below, gaps are formed between the lower surfaces 32*d* of the outer core portions 32 and a bottom plate portion 61 of the casing 6 (see FIG. 5).

The inner core pieces 31*m* and the outer core pieces 32*m* are powder compacts that include soft magnetic powder. A powder compact is typically obtained by molding a raw material powder that contains soft magnetic powder of a metal such as iron or an iron alloy (a Fe—Si alloy, a Fe—Ni alloy, etc.), and a binder (resin, etc.) and a lubricant if necessary, and then performing heat treatment for the purpose of eliminating distortion that occurs during the molding process, for example. By using coated powder obtained by applying an insulating treatment to metal powder, or mixed powder obtained by mixing metal powder and an insulative material, as raw material powder, it is possible to obtain a powder compact that substantially includes metal particles and insulative materials that are interposed between the metal particles, after performing molding. This powder compact includes an insulative material, and therefore it can reduce eddy currents, resulting in lower energy loss.

The inner core pieces 31*m* and the outer core pieces 32*m* may be constituted by molded members that are obtained by molding composite materials that include soft magnetic powder and molten resin through injection molding. The soft magnetic powder and the molten resin of the composite materials may be the same as the soft magnetic powder and molten resin that is used in the powder compact. Insulative coatings that are made of a phosphate or the like may be formed on the surfaces of magnetic particles. In addition, the inner core pieces 31*m* and the outer core pieces 32*m* may be constituted by stacked steel plates.

Inner Interposed Members and End Surface Interposed Members

As shown in FIGS. 2, 3, 5, and 6, the inner interposed members 4 and the end surface interposed members 5α are members that insulate the winding portions 2*a* and 2*b* and the magnetic core 3 from each other. The inner interposed members 4 and the end surface interposed members 5α may be formed using, for example, a polyphenylene sulfide (PPS) resin, a polytetrafluoroethylene (PTFE) resin, a liquid crystal polymer (LCP), a polyamide (PA) resin such as nylon 6 or nylon 66, and a thermoplastic resin such as a polybutylene terephthalate (PBT) resin or an acrylonitrile butadiene styrene (ABS) resin. In addition, it is also possible to use a thermosetting resin such as an unsaturated polyester resin, an epoxy resin, a urethane resin, or a silicone resin, to form the interposed members 4 and 5α. It is also possible to improve the heat dissipation properties of the interposed members 4 and 5α by mixing a ceramic filler into the aforementioned resins. A non-magnetic powder of alumina or silica, for example, may be used as the ceramic filler.

Inner Interposed Members

The inner interposed members 4 are interposed between the inner surfaces of the winding portions 2*a* and 2*b* and the inner core portions 31 of the magnetic core 3. This example is provided with a pair of inner interposed members 4, which are respectively provided for the winding portions 2*a* and 2*b*. The pair of inner interposed members 4 have the same shape, and one of the inner interposed members 4 is the same as the other of the inner interposed members 4 when rotated by 180° in a horizontal direction. Therefore, the following describes one of the inner interposed members 4 that is arranged for one of the winding portions 2*a* and 2*b*. In this example, the inner interposed member 4 includes a pair of divided interposed members 4A and 4B that have division surfaces that extend along the axial direction of the winding portion 2*a* (2*b*). The following describes the components of the inner interposed member 4 in detail, mainly with reference to FIGS. 2, 4, and 5.

The pair of divided interposed members 4A and 4B are members that each have a squared C shape, are not in contact with each other, and are arranged on portions of the inner core portions 31 in the circumferential direction (see FIG. 2). In this example, the pair of divided interposed members 4A and 4B are arranged so as to sandwich a plurality of inner core pieces 31*m* (three inner core pieces 31*m* in this example) that constitute the inner core portion 31 from the upper surfaces and the lower surfaces of the inner core pieces 31*m*. Each of the divided interposed members 4A and 4B includes a body portion 41 for arranging an inner core portion 31, and the left-right positioning portions (first positioning portions) 42 that position the outer core portions 32 in the left-right direction. The body portion 41 includes three U-shaped belt pieces 41*u* for arranging the inner core pieces 31*m*, and a pair of straight pieces 41*s* that connect end portions of the U-shaped belt pieces 41*u*. Distance keeping portions 43 that keep a distance between adjacent inner core pieces 31*m* to position the inner core pieces 31*m* relative to each other are provided on the inner surfaces of the straight pieces 41*s*. The gaps between the inner core pieces 31*m*, which are formed by the distance keeping portions 43, are filled with the constituent resin of the sealing resin portion 7 described below, and thus gap portions 31*g* (see FIG. 5) are formed using the constituent resin.

The three U-shaped belt pieces 41*u* are preferably shaped so as to be held at predetermined positions relative to the inner core pieces 31*m*. In this example, each U-shaped belt piece 41*u* is U-shaped so as to face three surfaces of an inner core piece 31*m*, namely an upper surface (a lower surface) and left and right surfaces. However, each U-shaped belt piece 41*u* may be L-shaped so as to face at least two faces that sandwich a corner of an inner core piece 31*m* (for example, an upper surface and a left side surface, or a lower surface and a right side surface). If each U-shaped belt piece 41*u* is L-shaped, it is preferable that the inner interposed members are located at diagonal corners of the inner core pieces 31*m*.

The three U-shaped belt pieces 41*u* are located in correspondence with three inner core pieces 31*m*, and are arranged such that gaps between the inner core pieces 31*m*, which are formed by the distance keeping portions 43, are exposed to the outside. Since the aforementioned gaps are exposed to the outside, the constituent resin of the sealing resin portion 7 is more likely to fill the gaps between the inner core pieces 31*m*. Out of the three U-shaped belt pieces 41*u*, the U-shaped belt pieces 41*u* located at the two ends are each provided with an engagement recessed portion 45 that engages with an engagement protruding portion 55 that is formed on a housing portion 51*c* of an end surface interposed member 5α, which will be described later. The engagement recessed portions 45 and the engagement protruding portions 55 engage with each other, and thus the inner interposed members 4 and the end surface interposed members 5α are prevented from being displaced in the left-right direction.

The pair of straight pieces 41*s* have different lengths. Out of the pair of straight pieces 41*s*, the straight piece 41*s* that is located on the inner core portion 31 side (the inner side) to which the straight piece 41*s* faces has a length that spans from one end of the three U-shaped belt pieces 41*u* that are arranged at intervals to the other end. On the other hand, out of the pair of straight pieces 41*s*, the straight piece 41*s* that is located farther from the inner core portion 31 (the outer side) to which the straight piece 41*s* faces is disposed so as to span from one end of the three U-shaped belt pieces 41*u* that are arranged at intervals to the other end, and includes extension portions that extend from the two ends of the U-shaped belt pieces 41*u* toward the outer core portions 32. These extension portions are the left-right positioning portions 42 that have a length that allows the extension portions to face the side surfaces of outer core portions 32 when the outer core portions 32 are combined using the end surface interposed members 5α, and position the outer core portions 32.

The left-right positioning portions 42 are respectively located at outer portions of the divided interposed members 4A and 4B. That is, when the divided interposed members 4A and 4B are provided on the inner core pieces 31*m*, the left-right positioning portions 42 are located at two upper positions and two lower positions relative to the inner core portions 31, outside the inner core portions 31. When the pair of inner interposed members 4 are provided on the inner core portions 31 and the coil 2 and the outer core portions 32 are attached thereto, the left-right positioning portions 42 are located at upper and lower positions, i.e. four positions in total, for each of the left and right side surfaces of the outer core portions 32, to face the outer core portions 32. This is because one of the inner interposed members 4 arranged on the pair of inner core portions 31 is the same as the other of the inner interposed members 4 when rotated by 180° in a horizontal direction. The positioning portions 42 of the pair of inner interposed members 4 are located so as to face the left and right surfaces of the outer core portions 32, and thus the outer core portions 32 are prevented from moving in the left-right direction (the width direction of the outer core portions 32).

End Surface Interposed Members

The end surface interposed members 5α are interposed between end surfaces of the winding portions 2*a* and 2*b* and the inner end surfaces 32*e* of the outer core portions 32. This example is provided with a pair of end surface interposed members 5α, which are provided on the end surfaces of the winding portions 2*a* and 2*b*. The pair of end surface interposed members 5α have the same shape, and one of the end surface interposed members 5α is the same as the other of the end surface interposed members 5α when rotated by 180° in a horizontal direction. Therefore, the following describes one of the end surface interposed members 5α that is located between end surfaces of winding portions 2*a* and 2*b* and the inner end surface 32*e* of an outer core portion 32. The following describes the components of the end surface interposed member 5α in detail, mainly with reference to FIGS. 2, 4, and 6.

The end surface interposed member 5α includes a frame 51 that has windows 51*w* at positions that correspond to the pair of inner core portions 31. When an outer core portion 32 is attached to the end surface interposed member 5α, the inner end surface 32*e* of the outer core portion 32 is exposed to the outside from the windows 51*w*. An upper surface 51*u* of the end surface interposed member 5α is located at a position that is lower than upper surfaces 2*u* of the winding portions 2*a* and 2*b* (see FIGS. 1 and 5). That is, the length of the end surface interposed member 5α in the top-bottom direction is shorter than the length of the winding portions 2*a* and 2*b* in the top-bottom direction, and the upper end surfaces of the winding portions 2*a* and 2*b* are exposed to the outside from the frame 51 of the end surface interposed member 5α. The windows 51*w* have a size that allows gaps to be formed between the inner peripheral edges of the windows 51*w* and the outer peripheral surface of the outer core portion 32 when the outer core portion 32 is located on the end surface interposed member 5α. The left-right positioning portions 42 are inserted to penetrate through the gaps.

The end surface interposed member 5α has various protrusions that are provided integrally with the frame 51. As protrusions that are provided on the surface that faces the winding portions 2*a* and 2*b*, of the frame 51, the end surface interposed member 5α has two housing portions 51*c* that house end portions of the pair of inner core portions 31, and a partition portion 51*p* that is interposed between the winding portions 2*a* and 2*b*. As protrusions that are provided on the surface that faces the outer core portion 32, of the frame 51, the end surface interposed member 5α has the top-bottom positioning portions (second positioning portions) 52 that position the outer core portion 32 in the top-bottom direction, and an abutting portion 53 against which the left side surface of the outer core portion 32 abuts. As protrusions that are provided at the inner peripheral edge of the frame 51 (the inner peripheral edges of the windows 51*w*), the end surface interposed member 5α has engagement protrusions 54 that position the left-right positioning portions 42 of the inner interposed members 4. As protrusions that are provided at the outer peripheral edge of the frame 51, the end surface interposed member 5α has legs 57 that keep a distance between the bottom plate portion 61 of the casing 6 and the outer core portion 32, and case positioning portions 58 that keep a distance between a side wall 62 of the casing 6 and the combined body 10, and position the casing 6.

The housing portions 51*c* are provided near the peripheries of the windows 51*w* of the frame 51 so as to protrude from the frame 51 toward the winding portions 2*a* and 2*b*, so that end portions of the pair of inner core portions 31 can be housed. In this example, the housing portions 51*c* extend along portions of the inner core portions 31 in a circumferential direction, and have openings at two positions, namely an upper position and a lower position, in both the left and right portions of the frame 51. The upper and lower surfaces of the housing portion 51*c* are provided with the engagement protruding portions 55 that engage with the engagement recessed portions 45 of the inner interposed members 4. As a result of the engagement recessed portions 45 and the engagement protruding portions 55 engaging with each other, the inner interposed members 4 and the end surface interposed member 5α are positioned relative to each other in the left-right direction, and the left-right positioning portions 42 of the inner interposed members 4 are positioned relative to the end surface interposed member 5α.

The partition portion 51*p* is provided between the housing portions 51*c* so as to protrude from the frame 51 toward the winding portions 2*a* and 2*b*. When the winding portions 2*a* and 2*b* are attached to the end surface interposed member 5α, the partition portion 51*p* is interposed between the winding portions 2*a* and 2*b*, and insulates the winding portions 2*a* and 2*b* from each other.

The top-bottom positioning portions 52 are provided at top and bottom portions of the frame 51, at an interval that is equal to the height (the length in the top-bottom direction) of the outer core portion 32, and protrude from the frame 51, in a direction away from the winding portions 2*a* and 2*b*. In this example, the top-bottom positioning portions 52 are constituted by two plate-shaped pieces 52S that are provided on an upper portion of the frame 51, and one L-shaped piece 52L that is provided on a lower portion of the frame 51. The L-shaped piece 52L is located near a central portion of the outer core portion 32 in the let-right direction, and the two plate-shaped pieces 52S are located at an interval that is approximately equal to the width of the L-shaped piece 52L. The L-shaped piece 52L is constituted by a long piece that extends in the protruding direction and a short piece whose end portion in the protruding direction is bent upward by approximately 90°. As a result of the outer core portion 32 being provided on the end surface interposed member 5α, the upper surface of the outer core portion 32 faces the two plate-shaped pieces 52S, and the lower surface of the outer core portion 32 faces the long piece of the one L-shaped piece 52L. As a result of the two plate-shaped pieces 52S and the long piece of the L-shaped piece 52L being located so as to face the upper and lower surfaces of the outer core portion 32, the outer core portion 32 is prevented from moving in the top-bottom direction (the height direction of the outer core portion 32). The long piece of the L-shaped piece 52L also supports the outer core portion 32.

The short piece of the L-shaped piece 52L is located so as to face the outer end surface (the surface that is farther from the inner core portion 31 than the other surface) of the outer core portion 32 in the front-rear direction. As a result of the short piece of the L-shaped piece 52L being located so as to face the outer end surface of the outer core portion 32, the outer core portion 32 is prevented from moving in the front-rear direction (the width direction of the outer core portion 32) between the short piece of the L-shaped piece 52L and a surface of the frame 51. That is, since the top-bottom positioning portions 52 include the L-shaped piece 52L, it is possible to position the outer core portion 32 in the front-rear direction as well as in the top-bottom direction.

The outer core portion 32 is positioned relative to the end surface interposed member 5α by being moved to slide in the left-right direction between the top-bottom positioning portions 52 (see FIG. 2). The abutting portion 53 is provided at a slide end position of the outer core portion 32 so as to protrude from the frame 51. In this example, the outer core portion 32 is moved to slide between the top-bottom positioning portions 52 from the right, and therefore the abutting portion 53 is located so as to abut against the left side surface of the outer core portion 32. As a result of the outer core portion 32 being moved to slide between the top-bottom positioning portions 52 until the left side surface of the outer core portion 32 abuts against the abutting portion 53, the outer core portion 32 can be positioned in the left-right direction (see FIGS. 2 and 3). If the outer core portion 32 is to be moved to slide between the top-bottom positioning portions 52 from the left, the abutting portion 53 is to be located such that the right side surface of the outer core portion 32 abuts against the abutting portion 53.

The engagement protrusions 54 are provided so as to protrude inward from outer portions, in the left-right direction, of the inner peripheral edges of the windows 51*w*, other than the upper and lower corners on the left and right sides of the windows 51*w*. Since the engagement protrusions 54 are provided at positions other than the above-described corners, the corners of the windows 51*w* and the outer peripheral surface of the outer core portion 32 and the engagement protrusions 54 form openings when the outer core portion 32 is attached to the end surface interposed member 5α (see FIG. 3). The left-right positioning portions 42 penetrate through and engage with the openings (see FIGS. 1 and 3).

The legs 57 are provided so as to protrude toward the bottom plate portion 61 (FIGS. 5 and 6) of the casing 6 described below from the outer peripheral edge of the frame 51. The legs 57 are located so as to keep a distance between the outer core portion 32 and the bottom plate portion 61 of the casing 6. In the example, two legs 57 are provided for one end surface interposed member 5α. Since there is a gap between the outer core portion 32 and the casing 6 due to the presence of the legs 57, the outer core portion 32 and the casing 6 are prevented from coming into direct contact, and vibrations of the magnetic core 3 including the outer core portion 32 are prevented from being transmitted to the casing 6.

The case positioning portions 58 are provided so as to protrude from the outer peripheral edge of the frame 51 toward the side wall 62 (FIG. 6) of the casing 6 described below. The case positioning portions 58 are located so as to position the casing 6 while keeping a distance between the combined body 10 and the side wall 62 of the casing 6. In this example, the case positioning portions 58 are provided so as to protrude from the two lower corners of the frame 51, in two directions, namely the left-right direction and the front-rear direction (see FIG. 4).

Casing

Figure 6:
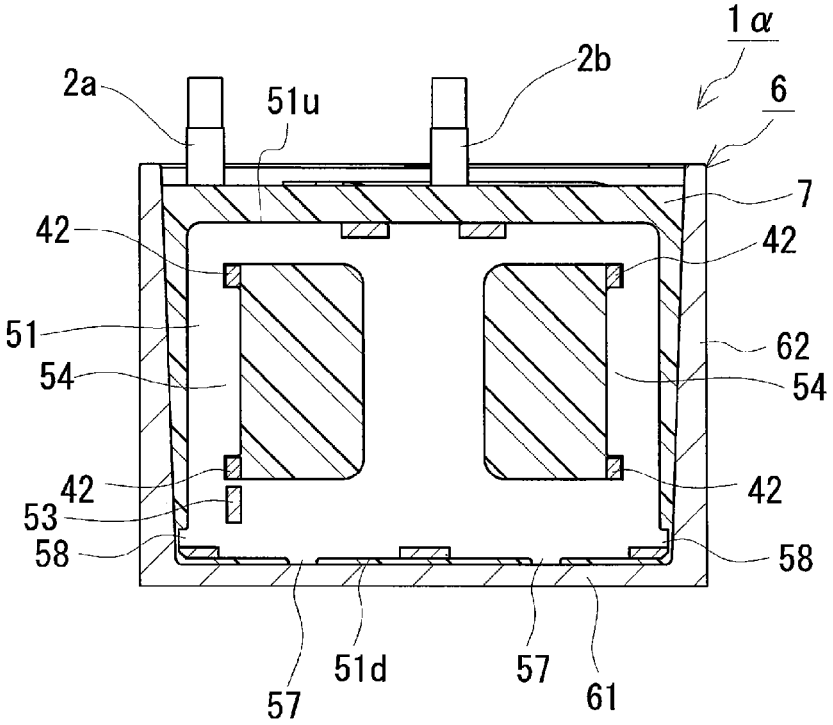
FIG. 6 is a cross-sectional view along (VI)-(VI) of the reactor shown in FIG. 1.
Figure 7:
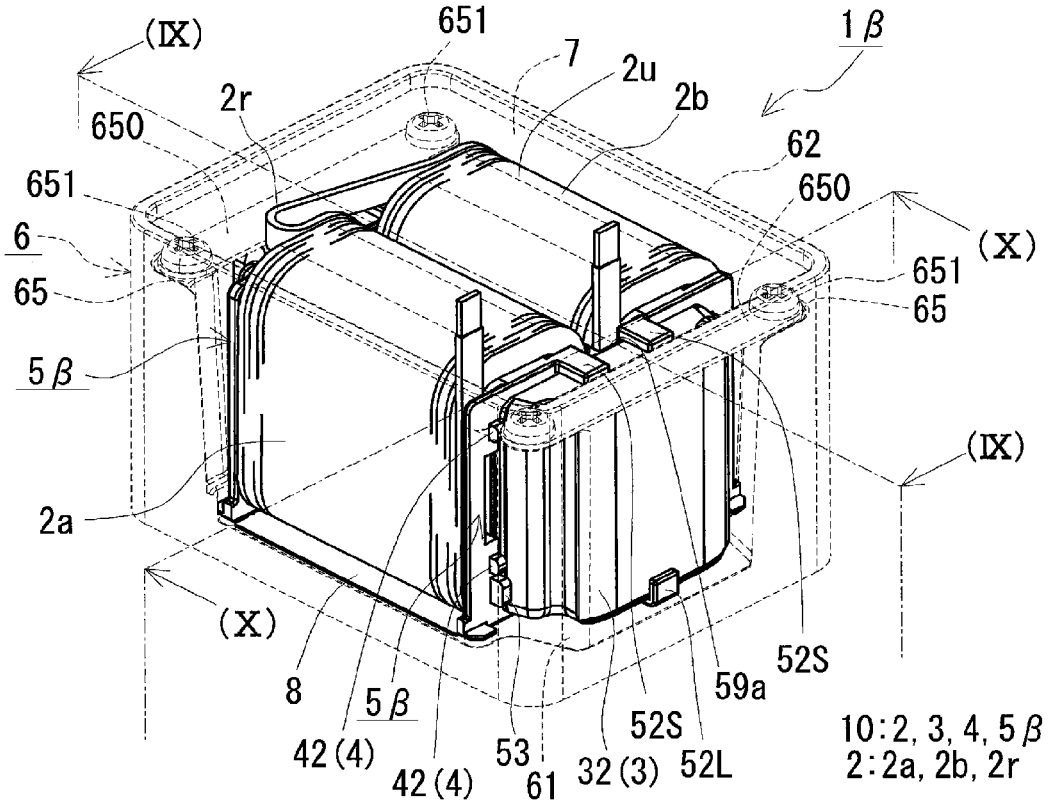
FIG. 7 is a schematic perspective view of a reactor according to a fourth embodiment.

As shown in FIGS. 1, 5, and 6, the casing 6 includes: the bottom plate portion 61 that is flat and on which the combined body 10 is mounted; and the side wall 62 that has a substantially rectangular frame shape and stands on the bottom plate portion 61 and surrounds the combined body 10. The casing 6 has a substantially rectangular box shape with an opening that is on the opposite side (upper side) to the bottom plate portion 61. In the reactor 1α, the combined body 10 is housed in the casing 6. Thus, it is possible to protect the combined body 10 from the external environment (dust, corrosion, etc.), and to provide mechanical protection. In this example, the lower surface of the bottom plate portion 61 of the casing 6 is fixed so as to be in contact with the upper surface of an installation target such as a cooling base (not shown), and the reactor 1α is installed on the installation target. Although FIGS. 1, 5, and 6 show an installation state in which the bottom plate portion 61 is on the lower side, the bottom plate portion 61 may be on the upper side or a lateral side.

The casing 6 shown in this example is a metal casing into which the bottom plate portion 61 and the side wall portion 62 are integrated. In general, metal has a relatively high thermal conductivity. Therefore, if a metal casing is used, the entire casing can be used as a heat dissipation path, and heat that is generated by the combined body 10 can be efficiently dissipated to an external installation target (e.g. a cooling base). Thus, the heat dissipation properties of the reactor 1α can be improved. Examples of the constituent material of the casing 6 include, aluminum and an alloy thereof, magnesium and an alloy thereof, copper and an alloy thereof, silver and an alloy thereof, iron, and austenitic stainless steel. The casing 6 can be lightweight if it is formed using aluminum, magnesium, or an alloy of aluminum and magnesium.

The casing 6 shown in this example is provided with stay attachment portions 65 at the four corners of the casing 6. Stays 650 are arranged over the upper surfaces of the outer core portions 32, and the stays 650 are fixed to the stay attachment portions 65 using screws 651. Thus, the combined body 10 can be fixed to the casing 6, with the combined body 10 being pressed to the bottom plate portion 61.

Joining Layer

As shown in FIGS. 1 and 5, the reactor 1α shown in this example is provided with a joining layer 8 on the installation surface of the combined body 10. The joining layer 8 is interposed between the lower surface of the coil 2 of the combined body 10 and the bottom plate portion 61. Due to the joining layer 8 being provided, the combined body 10 can be firmly fixed to the bottom plate portion 61. Thus, it is possible to restrict the coil 2 from moving, improve the heat dissipation properties, and stably fix the reactor 1α to the installation target. Preferably, the constituent material of the joining layer 8 is a material that includes an insulative resin, in particular, a ceramic filler or the like, and has excellent heat dissipation properties (e.g. a thermal conductivity of 0.1 W/m·K or more, even more preferably 1 W/m·K or more, and particularly preferably 2 W/m·K or more). Specific examples of the resin include thermosetting resins such as an epoxy resin, a silicone resin, and unsaturated polyester, and thermoplastic resins such as a PPS resin and LCP. The joining layer 8 may have a sheet-like shape, or be formed through coating or spraying.

Sealing Resin Portion

As shown in FIGS. 1, 5, and 6, the sealing resin portion 7 is a member that fills the casing 6, and seals the combined body 10 that is housed in the casing 6. The sealing resin portion 7 fills the casing 6 such that portions of the combined body 10, excluding end portions of both wiring portions and the upper surfaces 2*u* of the coil 2, are embedded in the sealing resin portion 7 (see FIG. 5). In the reactor 1α, the combined body 10 is sealed using the sealing resin portion 7, and the combined body 10 is thereby fixed to the casing 6. Thus, it is possible to electrically and mechanically protect the combined body 10, protect the combined body 10 from the external environment, prevent the magnetic core 3 from vibrating when electricity is applied to the coil 2, and reduce noise that is caused by the vibrations.

As shown in FIG. 5, the constituent resin of the sealing resin portion 7 fills the gaps between the inner core pieces 31*m* formed by the distance keeping portions 43 of the inner interposed members 4 (FIG. 4) and the gaps between the inner core pieces 31*m* and the outer core pieces 32*m* formed by the frame 51 of the end surface interposed member 5α. The gap portions 31*g* that are interposed between the core pieces are formed by the constituent resin of the sealing resin portion 7.

The constituent resin of the sealing resin portion 7 also fills the gaps between the lower surfaces 32*d* of the outer core portions 32 and the bottom plate portion 61 of the casing 6, formed by the legs 57 of the end surface interposed member 5α. Due to the constituent resin of the sealing resin portion 7 being provided, vibrations of the magnetic core 3 including the outer core portions 32 are prevented from being transmitted to the casing 6.

As the constituent resin of the sealing resin portion 7, an epoxy resin, a urethane resin, a silicone resin, an unsaturated polyester resin, or a PPS resin may be used, for example. In particular, an epoxy resin and a urethane resin are preferable because they are soft and inexpensive. From the view point of improving the heat dissipation properties, ceramic filler with a high thermal conductivity, such as alumina or silica, may be mixed into the sealing resin portion 7.

Method for Manufacturing Reactor

The reactor 1α that has the above-described configuration can be manufactured by, for example: assembling the inner core pieces 31*m* and the inner interposed members 4 to manufacture an assembly A; assembling the assembly A and the coil 2 to manufacture an assembly B; assembling the outer core pieces 32*m* and the end surface interposed members 5α to manufacture an assembly C; assembling the assembly B and the assembly C to manufacture the combined body 10; putting the combined body 10 into the casing 6; and filling the casing 6 with the unsolidified constituent resin of the sealing resin portion 7 and solidifying the constituent resin.

Manufacturing of Assembly A

As shown in FIG. 2, the plurality of inner core pieces 31*m* are sandwiched between the pair of divided interposed members 4A and 4B, and thus the assembly A is manufactured. At this time, the distance keeping portions 43 (FIG. 4) that are formed on the divided interposed members 4A and 4B are interposed between the inner core pieces 31*m*. As a result, the inner core pieces 31*m* are positioned, and gaps that match the thickness of the gap portions 31*g* are formed between the inner core pieces 31*m*.

Manufacturing of Assembly B

As shown in FIGS. 2 and 3, the assembly A including the inner core pieces 31*m* sandwiched between the pair of divided interposed members 4A and 4B is inserted into the winding portions 2*a* and 2*b* of the coil 2, and thus the assembly B is manufactured.

Manufacturing of Assembly C

As shown in FIGS. 2 and 3, the outer core pieces 32*m* (the outer core portions 32) are attached to the end surface interposed members 5α, and thus the assembly C is manufactured. At this time, the outer core portions 32 are moved to slide from the right (see the arrows shown in FIG. 2) between the top-bottom positioning portions 52 until the outer core portions 32 abut against the abutting portions 53 (see FIG. 3). As a result, the top-bottom positioning portions 52 are located so as to face the upper surfaces and the lower surfaces of the outer core portions 32, and thus the outer core portions 32 are positioned in the top-bottom direction. Also, the short pieces of the L-shaped pieces 52L of the top-bottom positioning portions 52 are located to face the outer end surfaces of the outer core portions 32 in the front-rear direction, and thus the outer core portions 32 are positioned in the front-rear direction as well. In this example, the inner end surfaces 32*e* of the outer core portions 32 are uniformly flat surfaces, and do not have portions that are inserted into the windows 51*w* of the end surface interposed members 5α, and therefore spaces are present in the windows 51*w*. These spaces are filled with the constituent resin of the sealing resin portion 7 as described below.

Manufacturing of Combined Body

As shown in FIG. 3, the assembly B (an assembly of the inner core pieces 31*m*, the inner interposed members 4, and the coil 2) and the assembly C (an assembly of the outer core portions 32 and the end surface interposed members 5α) are assembled, and thus the combined body 10 is manufactured. At this time, the left-right positioning portions 42 of the inner interposed members 4 penetrate through the openings that are formed by the corners of the windows 51*w* of the end surface interposed members 5α, the engagement protrusions 54, and the outer peripheral surfaces of the outer core portions 32. As a result, the left-right positioning portions 42 are located so as to face the left side surfaces and the right side surfaces of the outer core portions 32, and thus the outer core portions 32 are positioned in the left-right direction. The combined body 10 thus obtained can be treated as an integrated body in which the outer core portions 32 are positioned by the inner interposed members 4 and the end surface interposed members 5α in three directions, namely the left-right direction, the top-bottom direction, and the front-rear direction.

Putting Combined Body into Casing

The combined body 10 is put into the casing 6 (see FIGS. 1, 5, and 6). In this example, first, the joining layer 8 is positioned on the lower surface of the combined body 10, and then the combined body 10 is put into the casing 6. Also, the stays 650 are positioned on the upper surfaces 32*u* of the outer core portions 32, the stays 650 are fixed to the stay attachment portions 65 of the casing 6 using the screws 651, and thus the combined body 10 is fixed inside the casing 6. At this time, the combined body 10 is positioned in a state where gaps are formed between the lower surfaces 32*d* of the outer core portions 32 and the bottom plate portion 61 of the casing 6 due to the legs 57 of the end surface interposed members 5α, and gaps are formed between the combined body 10 and the side wall 62 of the casing 6 due to the case positioning portions 58 of the end surface interposed members 5α. Also, out of the lower surfaces of the end surface interposed members 5α in the combined body 10, lower surfaces 51*d*, excluding the legs 57, are not in contact with the bottom plate portion 61 of the casing 6, and gaps are formed between the lower surfaces 51*d* and the bottom plate portion 61 (see FIG. 6).

Filling and Solidifying Unsolidified Constituent Resin of Sealing Resin Portion

The casing 6 that houses the combined body 10 is filled with an unsolidified constituent resin of the sealing resin portion 7. For example, the constituent resin is fed from the lower side of the casing 6 by inserting a tube, which serves as a feeding port, into the gap between the outer periphery of the combined body 10 and the inner periphery of the casing 6, and placing the opening of the tube at a position near the bottom plate portion 61 of the casing 6. The liquid level of the constituent resin fed into the gap between the outer periphery of the combined body 10 and the inner periphery of the casing 6 moves upward from the lower side to the upper side of the casing 6 to cover the outer periphery of the coil 2 and the outer periphery of the magnetic core 3, and the constituent resin spreads throughout the gaps between the coil 2 and the magnetic core 3. The constituent resin flows into the winding portions 2*a* and 2*b* and the gap between the winding portions 2*a* and 2*b* from the gaps between the lower surfaces 51*d* of the end surface interposed members 5α and the bottom plate portion 61 of the casing 6, or from an end portion side of the winding portions 2*a* and 2*b* so as to cover the upper surfaces 51*u* of the end surface interposed members 5α. In this example, the upper surfaces 51*u* of the end surface interposed members 5α are located below the upper surfaces 2*u* of the winding portions 2*a* and 2*b*. Therefore, upon the liquid level of the constituent resin reaching the positions of the upper surfaces 51*u* of the end surface interposed members 5α, the constituent resin flows into the gap between the winding portions 2*a* and 2*b* from an end portion side of the winding portions 2*a* and 2*b*. The constituent resin that has flowed into the winding portions 2*a* and 2*b* flows into and fills the gaps between the plurality of inner core pieces 31*m*, which are formed by the distance keeping portions 43 (FIG. 4), and the gaps formed at the end surfaces (spaces in the windows 51*w*). By solidifying the constituent resin in this state, the combined body 10 is sealed and the gap portions 31*g* are formed between the inner core pieces 31*m* and at the end surfaces.

Other Components

The above-described reactor 1α may be provided with sensors (not shown) that measure physical amounts regarding the reactor 1α, such as a temperature sensor, a current sensor, a voltage sensor, and a magnetic flux sensor. Sensors may be located in a space that is formed between the winding portions 2*a* and 2*b*, for example. If this is the case, sensor holders for holding various kinds of sensors may be provided integrally with the end surface interposed members 5α.

Uses

The above-described reactor 1α can be used in a preferable manner in various converters such as an on-board converter (typically a DC-DC converter) that is mounted on a vehicle such as a hybrid vehicle, a plug-in hybrid vehicle, an electric vehicle, or a fuel cell vehicle, and a converter for an air conditioner, and in constituent components of a power conversion device.

Second Embodiment

The first embodiment is an embodiment in which the first positioning portions 42 of the inner interposed members 4 are located so as to penetrate through the windows 51*w* that are formed in the frames 51 of the end surface interposed members 5α. Alternatively, through holes (not shown) other than the windows 51*w* may be formed in the end surface interposed members 5α and the first positioning portions 42 may be located to penetrate through the through holes.

Figure 4:
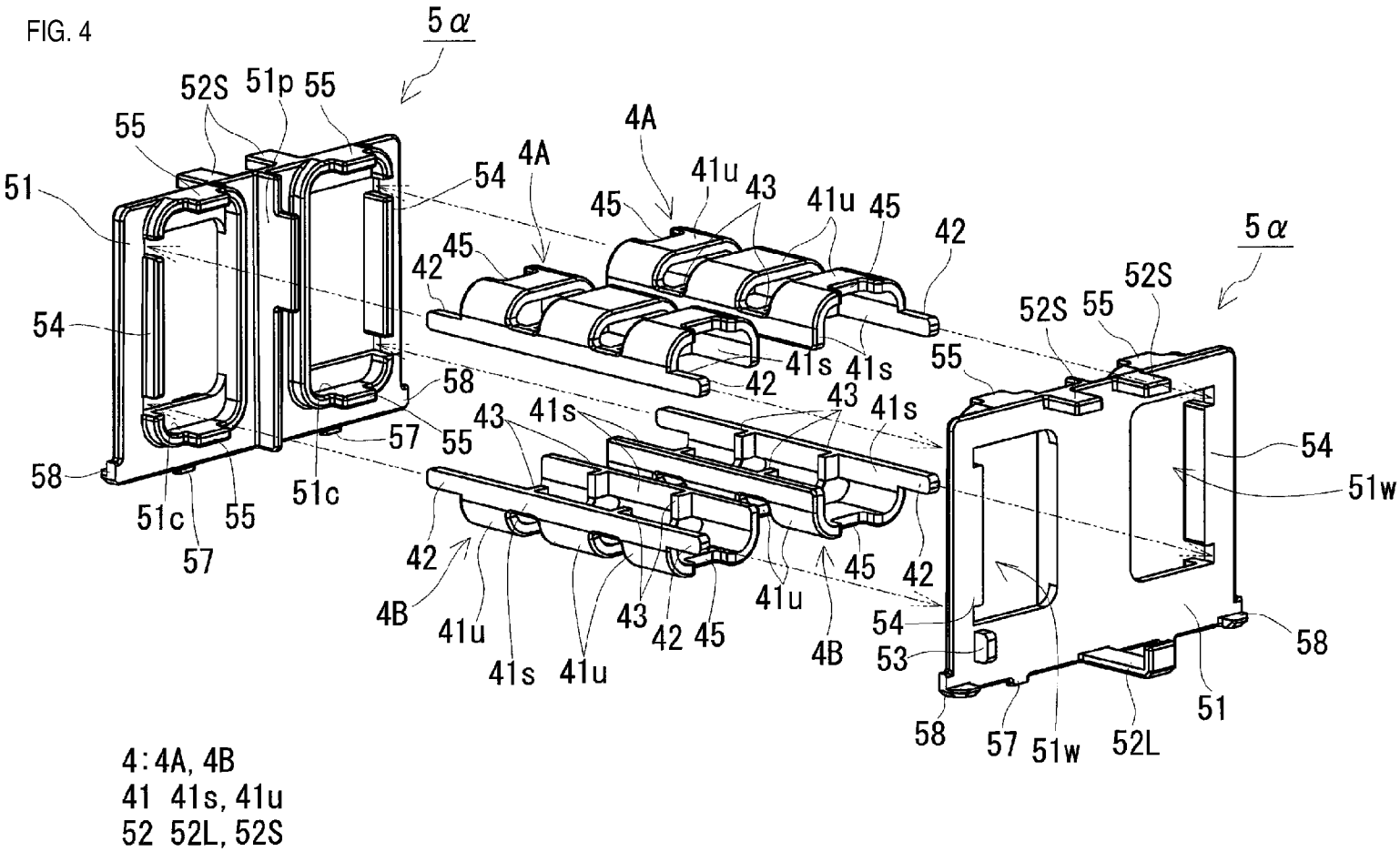
FIG. 4 is a perspective view of interposed members that are included in the reactor according to the first embodiment.

The first embodiment is an embodiment in which each end surface interposed member 5α includes the frame 51 that has two windows 51*w* whose entire peripheries are closed, and has a B shape when seen in a lateral direction (see FIGS. 2 and 4). Alternatively, each end surface interposed member may have a frame that has an H shape whose left and right outer portions are open. Such a frame has a shape that can be obtained by combing two C-shaped members such that the openings thereof face away from each other. The end portions of the frame, which form the C-shaped openings, include extension portions that extend slightly downward from the upper corners of an outer portion of the frame in the left-right direction, and extension portions that extend slightly upward from the lower corners of the outer portion of the frame in the left-right direction. When the outer core portions 32 are attached to the end surface interposed members, gaps are formed between the above-described extension portions of the frames and the outer peripheral surfaces of the outer core portions 32. The first positioning portions 42 engage with the gaps, and are located so as to face the left and right surfaces of the outer core portions 32. Due to the frames being provided with the extension portions, the first positioning portions 42 are prevented from moving to increase the width in the left-right direction in a state where the first positioning portions 42 engage with the end surface interposed members. The extension portions need only to have a length that is sufficient to restrict the first positioning portions 42 from moving in the left-right direction.

Third Embodiment

The first embodiment is an embodiment in which the inner interposed members 4 are provided with left-right positioning portions 42 that position the left and right surfaces of the outer core portions 32, and the end surface interposed members 5α are provided with the top-bottom positioning portions 52 that position the upper and lower surfaces of the outer core portions 32. Alternatively, the inner interposed members may be provided with top-bottom positioning portions that position the upper and lower surfaces of the outer core portions, and the end surface interposed members may be provided with left-right positioning portions that position the left and right side surfaces of the outer core portions. The top-bottom positioning portions are provided so as to protrude from the inner interposed members to face the upper and lower surfaces of the outer core portions. The left-right positioning portions are provided so as to protrude from the end surface interposed members (the frames) to face the left and right side surfaces of the outer core portions. If this is the case, the outer core portions 32 are arranged by being moved to slide in the top-bottom direction between the left-right positioning portions relative to the end surface interposed members. Therefore, the abutting portions are to be located so as to abut against the upper or lower surfaces of the outer core portions.

Fourth Embodiment

To form the sealing resin portion 7 in the end surface interposed members 5α described in the first embodiment, flow channels for the unsolidified constituent resin of the sealing resin portion 7 to flow into the gap between the winding portions 2*a* and 2*b* and the spaces in the winding portions 2*a* and 2*b* may be provided. As shown in FIGS. 7 to 10, a reactor 1β according to a fourth embodiment is provided with end surface interposed members 5β that are each provided with an upper cutout 59*a* and inner cutouts 59*b*. The upper cutout 59*a* is formed in the upper surface 51*u* of the frame 51 of each end surface interposed member 5β at a central position that corresponds to the gap between the pair of winding portions 2*a* and 2*b*, and mainly serves as a resin flow channel to the gap between the winding portions 2*a* and 2*b*. The inner cutouts 59*b* are formed at the inner edge of each window 51*w* of the frame 51 of each end surface interposed members 5β, and mainly serves as a resin flow channel to the inside of the winding portions 2*a* and 2*b*. The reactor 1β according to the fourth embodiment is different from the first embodiment only in that the end surface interposed members 5β are provided with the cutouts 59*a* and 59*b*, and the other components are the same as those of the first embodiment.

End Surface Interposed Members

Upper Cutouts

Figure 9:
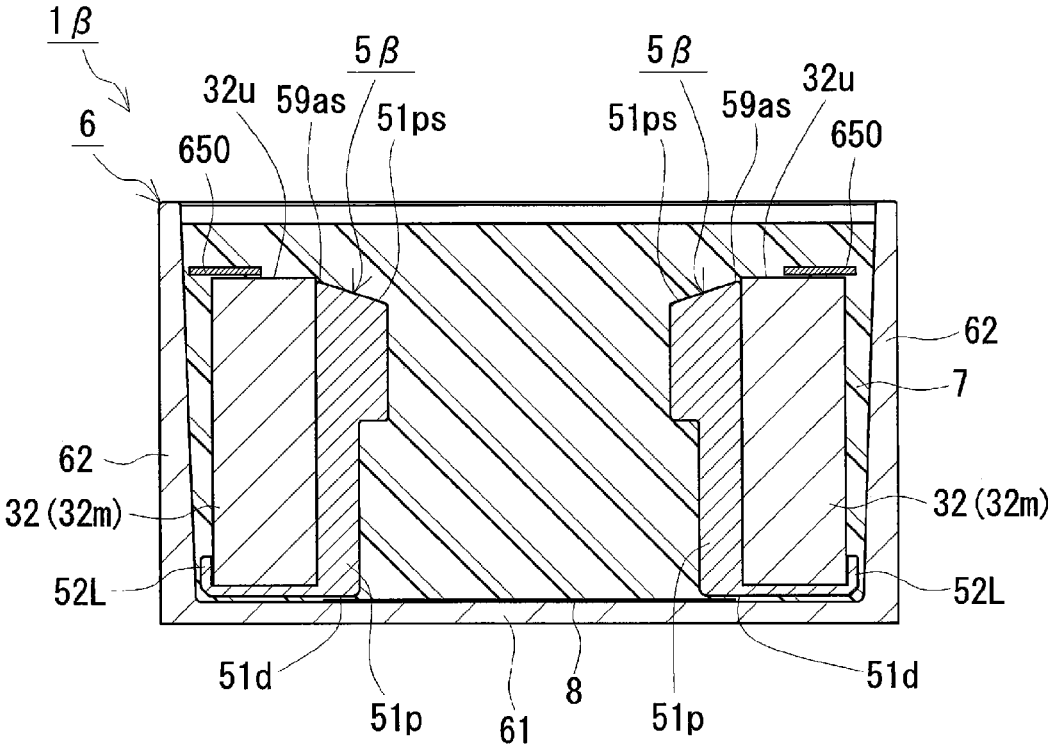
FIG. 9 is a cross-sectional view along (IX)-(IX) of the reactor shown in FIG. 7.

The upper cutouts 59*a* are formed such that the gap between the pair of winding portions 2*a* and 2*b* is exposed to the outside. In this example, the upper cutouts 59*a* are substantially rectangular cutouts that are formed such that corners, and end surfaces near the corners, of the winding portions 2*a* and 2*b*, which form the gap between the pair of winding portions 2*a* and 2*b*, are exposed to the outside (see FIGS. 7 and 10). The lowermost surfaces of the upper cutouts 59*a* are located below the upper surfaces 32*u* of the outer core portions 32 (see FIG. 9). As shown in FIG. 9, the lowermost surfaces of the upper cutouts 59*a* are provided with cutout inclined portions 59*as* that are inclined downward from the outer core portion 32 side toward the gap between the winding portions 2*a* and 2*b*. Also, in this example, the upper surfaces of the partition portions 51*p* interposed between the winding portions 2*a* and 2*b* are provided with partition inclined portions 51*ps* that are continuous with the above-described cutout inclined portions 59*as*.

Inner Cutouts

Figure 8:
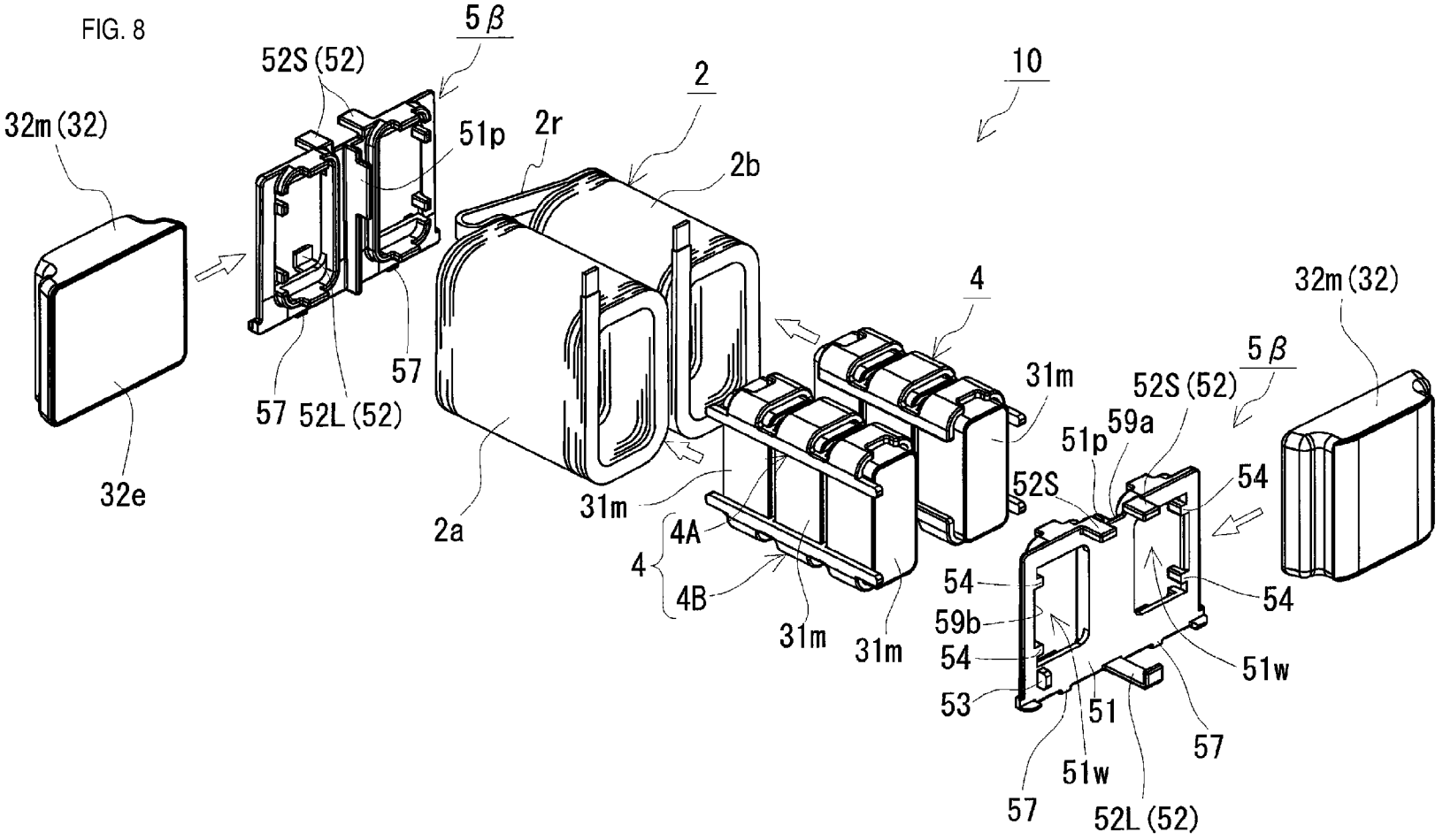
FIG. 8 is a schematic exploded perspective view of the reactor according to the fourth embodiment.
Figure 10:
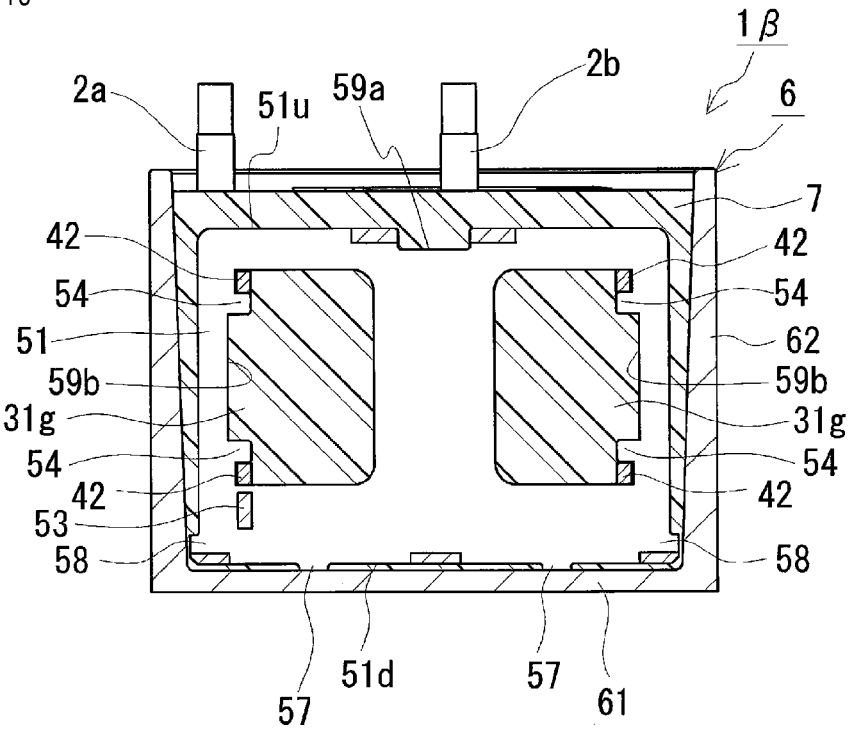
FIG. 10 is a cross-sectional view along (X)-(X) of the reactor shown in FIG. 7.
Figure 11:
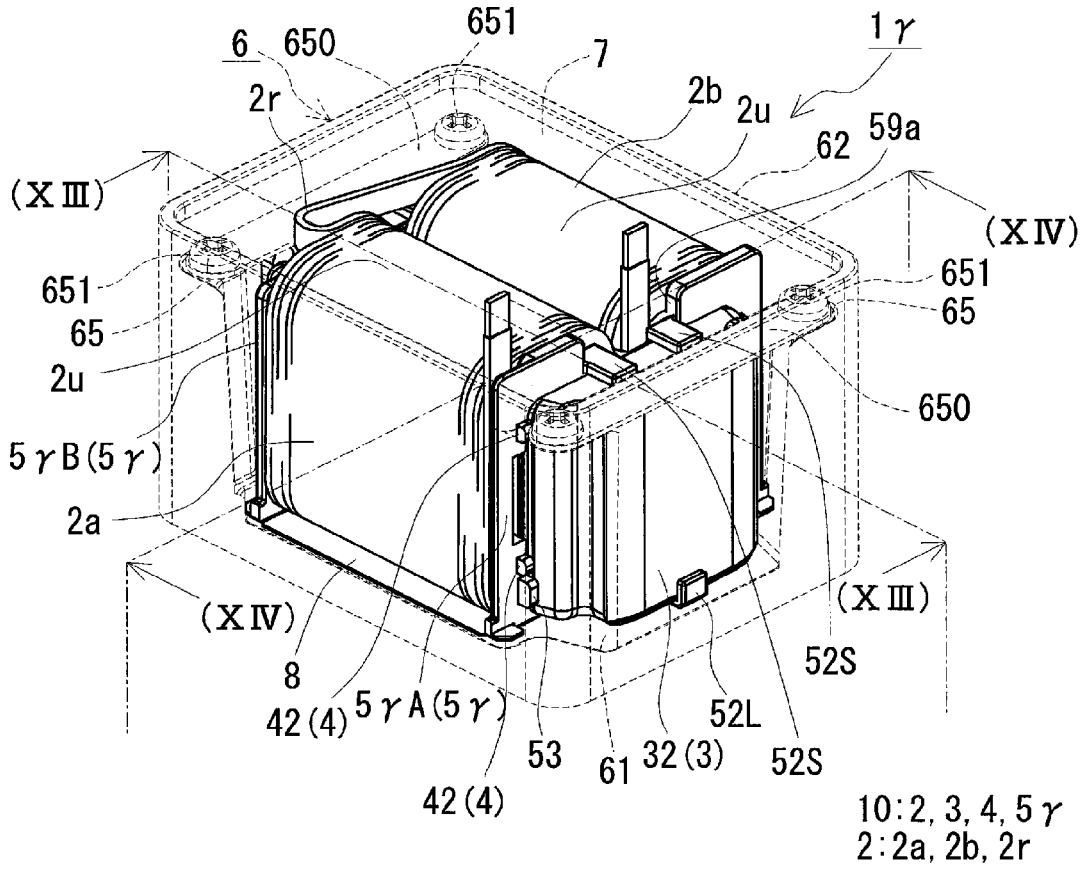
FIG. 11 is a schematic perspective view of a reactor according to a fifth embodiment.

The inner cutouts 59*b* are formed in outer portions, in the left-right direction, of the inner peripheral edges of the windows 51*w* of the frames 51, at positions between the engagement protrusions 54 (see FIGS. 8 and 10). Specifically, when the outer core portions 32 are attached to the end surface interposed members 5β, openings are formed by the inner cutouts 59*b*, the engagement protrusions 54, and the outer peripheral surfaces of the outer core portions 32, and these openings serve as flow channels for the constituent resin.

Resin that has a viscosity greater than or equal to 10 Pa·s at 20° C. is used as the constituent resin, for example. Such a high-viscosity resin is unlikely to flow into small gaps such as the gap between the winding portions 2*a* and 2*b* and the gap in the winding portions 2*a* and 2*b*. Therefore, resin flow channels such as the upper cutouts 59*a* and the inner cutouts 59*b* are provided so that the constituent resin can easily flow into the gap between the winding portions 2*a* and 2*b* and the spaces in the winding portions 2*a* and 2*b* to form the sealing resin portion 7. In particular, since the end surface interposed members 5β are provided with the upper cutouts 59*a*, the constituent resin fed into the gap between the outer peripheral surface of the combined body 10 and the inner peripheral surface of the casing 6 flows by itself into the gap between the winding portions 2*a* and 2*b* from the upper cutouts 59*a* upon the liquid level of the constituent resin reaching the level of the upper cutouts 59*a*. In particular, since the cutout inclined portions 59*as* and the partition inclined portions 51*ps* are provided, the constituent resin flows along the inclined portions 59*as* and 51*ps*, and the constituent resin more quickly flows into the gap between the winding portions 2*a* and 2*b*. Also, since the end surface interposed members 5β are provided with the inner cutouts 59*b*, the constituent resin more reliably flows into the spaces in the winding portions 2*a* and 2*b*, and it is possible to fill the gaps formed between the inner core pieces 31*m* with the constituent resin, and more reliably form the gap portions using the constituent resin.

As flow channels other than the cutouts 59*a* and 59*b*, the frames 51 of the end surface interposed members 5β may be provided with through holes that penetrate through the frames 51 from the outer core portion 32 side toward the winding portions 2*a* and 2*b*.

Fifth Embodiment

The end surface interposed members 5β described in the fourth embodiment may be modified such that the upper surfaces 51*u* thereof are flush with the upper surfaces 2*u* of the winding portions 2*a* and 2*b* or protrude more upward than the upper surfaces 2*u* of the winding portions 2*a* and 2*b*. If the upper surfaces of the end surface interposed members are flush with the upper surfaces of the winding portions or protrude more upward than the upper surfaces of the winding portions, when a sealing resin portion is to be formed, unsolidified constituent resin for the sealing resin portion is unlikely to flow into the gap between the pair of winding portions and the spaces in the winding portions. In this case, when the constituent resin is fed into the gap between the outer peripheral surface of the combined body and the inner peripheral surface of the casing, the constituent resin flows from a lateral side of the winding portions to cover the upper surfaces of the winding portions upon the liquid level of the constituent resin reaching the upper surfaces of the winding portions, and flows into the gap between the pair of winding portions. As a result, air in the gap between the pair of winding portions is likely to be caught in the sealing resin and form bubbles.

Therefore, the end surface interposed members are provided with the upper cutouts. As a result, upon the constituent resin reaching the lowermost surfaces of the upper cutouts, the constituent resin flows into the gap between the pair of winding portions from the upper cutouts, and thus the upper cutouts achieve significant effects. As shown in FIGS. 11 to 14, a reactor 1γ according to a fifth embodiment is provided with an end surface interposed member 5γ (a first end surface interposed member 5γA) whose upper surface 51*u* (in this example, the uppermost surface excluding the upper cutout 59*a*) is flush with the upper surfaces 2*u* of the winding portions 2*a* and 2*b*. The reactor 1γ according to the fifth embodiment is different from the fourth embodiment in the size of the first end surface interposed member 5γA out of the end surface interposed members 5γ in the top-bottom direction (the top-bottom direction in FIG. 11) and the size of the upper cutout 59*a*. Also, as shown in FIG. 13, the reactor 1γ according to the fifth embodiment is different from the fourth embodiment in that the upper surfaces 2*u* of the winding portions 2*a* and 2*b*, excluding end portions of both winding portions of the coil 2 in the combined body 10, are embedded in the sealing resin portion 7. Other configurations are the same as those in the fourth embodiment.

End Surface Interposed Members

The end surface interposed members include a first end surface interposed member 5γA that is interposed between one pair of end surfaces of the winding portions 2*a* and 2*b* and one outer core portion 32 out of the pair of outer core portions 32, and a second end surface interposed member 5γB that is interposed between the other pair of end surfaces of the winding portions 2*a* and 2*b* and the other outer core portions 32 out of the pair of outer core portions 32. The first end surface interposed member 5γA and the second end surface interposed member 5γB are different in size in the top-bottom direction (the top-bottom direction in FIG. 11) and in the size of the upper cutout 59*a*, and the other configurations are the same.

First End Surface Interposed Member

Figure 12:
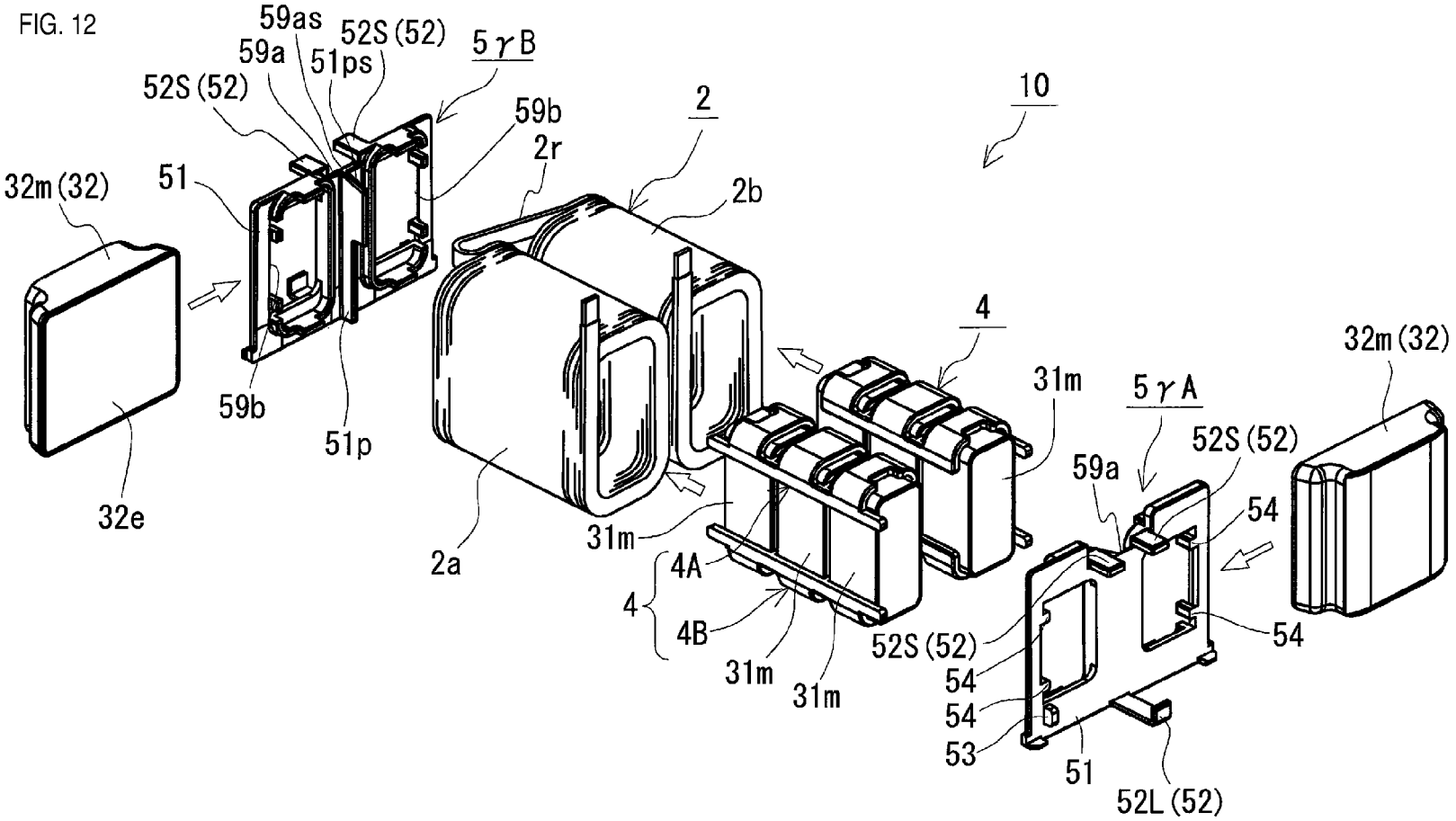
FIG. 12 is a schematic exploded perspective view of the reactor according to the fifth embodiment.
Figure 13:
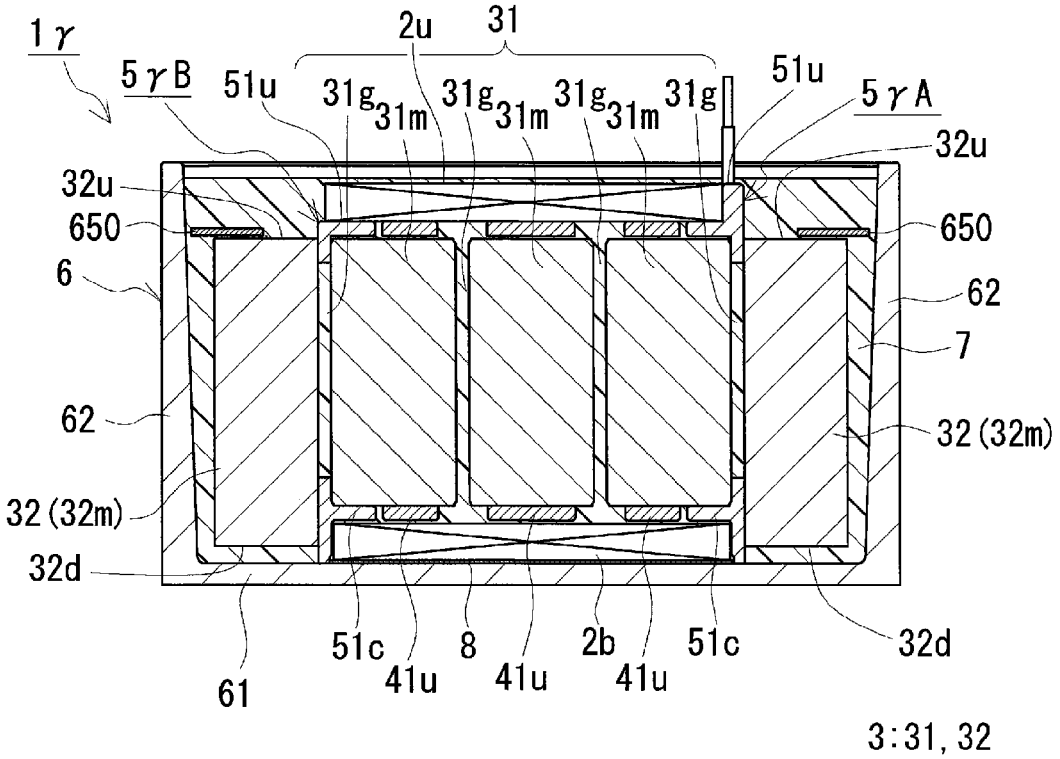
FIG. 13 is a cross-sectional view along (XIII)-(XIII) of the reactor shown in FIG. 11.
Figure 14:
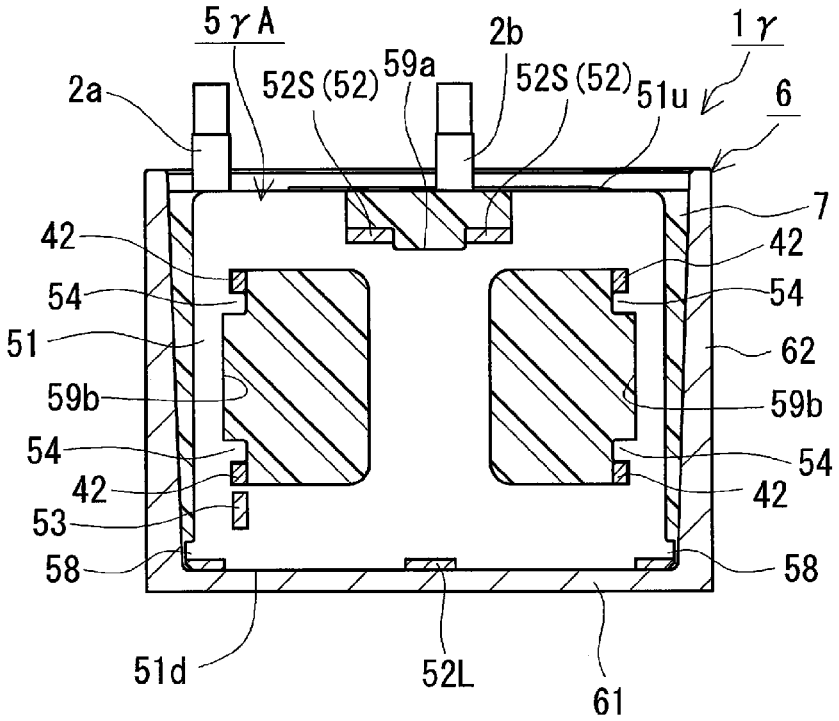
FIG. 14 is a cross-sectional view along (XIV)-(XIV) of the reactor shown in FIG. 11.

The first end surface interposed member 5γA is interposed between end surfaces of the winding portions 2*a* and 2*b* and the inner end surface 32*e* of an outer core portion 32, the end surfaces being located on the side where two end portions of the coil 2 are located (the right side in FIG. 12). The first end surface interposed member 5γA does not have legs (legs 57 in FIG. 10). The lower surface 51*d* of the frame 51 is in contact with the bottom plate portion 61 of the casing 6 (see FIG. 14). The upper surface 51*u* of the frame 51 is flush with the upper surfaces 2*u* of the winding portions 2*a* and 2*b* (see FIG. 13). That is, the length of the first end surface interposed member 5γA in the top-bottom direction is almost the same as the length of the winding portions 2*a* and 2*b* in the top-bottom direction, and the frame 51 of the first end surface interposed member 5γA substantially covers the end surfaces of the winding portions 2*a* and 2*b*. The length of the first end surface interposed member 5γA in the left-right direction is almost the same as the length of the winding portions 2*a* and 2*b* in the left-right direction.

The first end surface interposed member 5γA is provided with the top-bottom positioning portions 52 (the plate-shaped pieces 52S) at positions that are close to the center of the frame 51. Therefore, the two end portions of the bottom surface of the upper cutout 59*a* formed in the first end surface interposed member 5γA are constituted by the upper surfaces of the top-bottom positioning portions 52 (the plate-shaped pieces 52S) (see FIG. 14). The lowermost surface of the upper cutout 59*a* is located at a position that is lower than the upper surfaces 32*u* of the outer core portions 32. However, portions of the bottom surface of the upper cutout 59*a* that are constituted by the top-bottom positioning portions 52 (the plate-shaped pieces 52S) are located at positions that are higher than the upper surfaces 32*u* of the outer core portions 32.

Second End Surface Interposed Member

The second end surface interposed member 5γB is interposed between end surfaces of the winding portions 2*a* and 2*b* and the inner end surface 32*e* of an outer core portion 32, the end surfaces being located on the side where the coupling portion 2*r* of the coil 2 is located (the left side in FIG. 12). The second end surface interposed member 5γB is the same as the end surface interposed members 5β in the fourth embodiment except that the second end surface interposed member 5γB does not have legs (the legs 57 in FIG. 8). Specifically, the upper surface 51*u* of the frame 51 of the second end surface interposed member 5γB is located at a position that is lower than the upper surfaces 2*u* of the winding portions 2*a* and 2*b* (see FIG. 13). In this example, the second end surface interposed member 5γB is located such that the lower surface 51*d* of the frame 51 is in contact with the bottom plate portion 61 of the casing 6. That is, the length of the second end surface interposed member 5γB in the top-bottom direction is shorter than the length of the winding portions 2*a* and 2*b* in the top-bottom direction, and portions of the end surfaces of the winding portions 2*a* and 2*b* are exposed to the outside from the frame 51 of the second end surface interposed member 5γB. This is because the coupling portion 2*r* of the coil 2 is formed so as to protrude outward in the axial direction of the winding portions 2*a* and 2*b* such that the coupling portion 2*r* is located to be flush with the upper surfaces 2*u* of the winding portions 2*a* and 2*b* at a high position relative to the outer core portion 32. The length of the second end surface interposed member 5γB in the left-right direction is almost the same as the length of the winding portions 2*a* and 2*b* in the left-right direction.

The upper cutout 59*a* formed in the second end surface interposed member 5γB is the same as the upper cutout 59*a* in the fourth embodiment. The top-bottom width of the upper piece of the frame 51 of the second end surface interposed member 5γB (the length between the peripheral edges of the windows 51*w* and the outer edge of the frame 51) is shorter than that of the first end surface interposed member 5γA due to the coupling portion 2*r* of the coil 2 being provided. Therefore, the depth of the upper cutout 59*a* formed in the frame 51 of the second end surface interposed member 5γB is smaller than the depth of the upper cutout 59*a* formed in the frame 51 of the first end surface interposed member 5γA. The second end surface interposed member 5γB is provided with the plate-shaped pieces 52S of the top-bottom positioning portions 52 at positions that are close to the center of the frame 51, and the upper surfaces of the plate-shaped pieces 52S constitute the upper surface 51*u* of the frame 51. Therefore, the upper cutout 59*a* of the second end surface interposed member 5γB is located between the plate-shaped pieces 52S. Thus, the width of the upper cutout 59*a* (in the left-right direction in FIG. 14) is smaller than that of the first end surface interposed member 5γA by the total length of the plate-shaped pieces 52S.

The flow of the constituent resin when unsolidified constituent resin of the sealing resin portion 7 is fed into an outer peripheral area between the inner peripheral surface of the casing 6 that houses the combined body 10 and the outer peripheral surface of the combined body 10 in a case where the sealing resin portion 7 is to be formed in the reactor 1γ in this example will be described with reference to FIG. 15. The liquid level of the constituent resin fed into the above-described outer peripheral area rises from the lower side to the upper side of the casing 6. In the meantime, almost no constituent resin is fed into an inner peripheral area between the pair of winding portions 2*a* and 2*b*. This is because the end surface interposed members 5γ are located such that the lower surfaces 51*d* are in contact with the bottom plate portion 61 of the casing 6 and no gap is formed between the lower surfaces 51*d* and the bottom plate portion 61. Also, resin that has high viscosity (constituent resin that has high thixotropy and does not easily flow through a narrow flow channel) is used as the constituent resin, and the constituent resin does not easily flow into the spaces in the winding portions 2*a* and 2*b* through small gaps such as gaps between adjacent turns of the winding portions 2*a* and 2*b*. The constituent resin flows into the inner peripheral area upon the liquid surface of the constituent resin that is fed into the outer peripheral area reaching the upper cutouts 59*a* of the end surface interposed members 5γ. At this time, a large amount of the constituent resin fed into the outer peripheral area is used to fill the inner peripheral area, and therefore the rise of the liquid surface of the constituent resin in the outer peripheral area is very small until the inner peripheral area is filled with the constituent resin. On the other hand, since the upper surfaces 2*u* of the winding portions 2*a* and 2*b* are higher than the lowermost surfaces of the upper cutouts 59*a* of the end surface interposed members 5γ, the constituent resin flows from a side surface side of the winding portions 2*a* and 2*b* so as to cover the winding portions 2*a* and 2*b*, and does not flow into the inner peripheral area until the liquid level of the constituent resin reaches the upper surfaces 2*u* of the winding portions 2*a* and 2*b*. That is, before the constituent resin flows from a side surface side of the winding portions 2*a* and 2*b* into the gap between the pair of winding portions 2*a* and 2*b* so as to cover the winding portions 2*a* and 2*b* (the dotted arrows in FIG. 15), the constituent resin can flow into the gap between the pair of winding portions 2*a* and 2*b* due to the presence of the upper cutouts 59*a* in the end surface interposed members 5γ.

Figure 15:
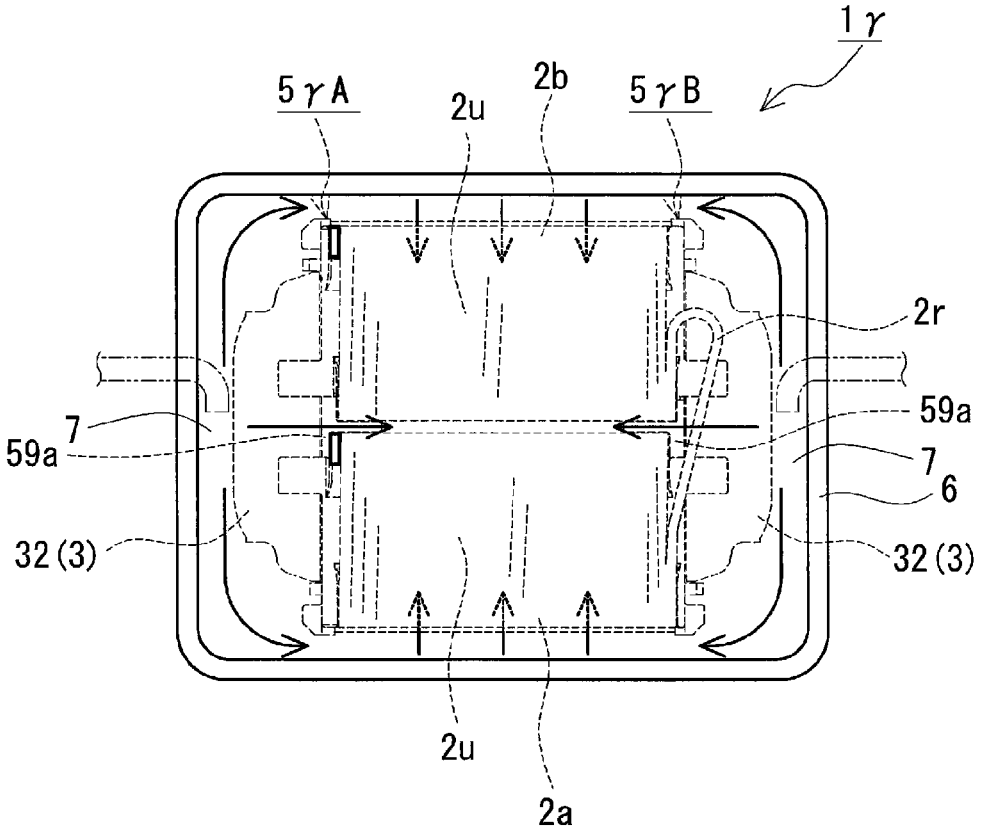
FIG. 15 is a schematic top view showing a flow of an unsolidified constituent resin of a sealing resin portion of the reactor according to the fifth embodiment when the sealing resin portion is formed.

Due to the end surface interposed member 5γ being provided with the upper cutout 59*a*, it is possible to efficiently fill the gap between the pair of winding portions 2*a* and 2*b* from an end portion side of the winding portions 2*a* and 2*b* as indicated by the flow of the constituent resin in FIG. 15 in the case of a configuration in which it is difficult to fill the gap between the pair of winding portions 2*a* and 2*b* with the constituent resin from a lower side of the combined body 10, such as a configuration in which (1) the upper surfaces 51*u* of the end surface interposed members 5γ are flush with the upper surfaces 2*u* of the winding portions 2*a* and 2*b* or protrude further upward than the upper surfaces 2*u* of the winding portions 2*a* and 2*b*, (2) the lower surfaces 51*d* of the end surface interposed members 5γ are in contact with the bottom plate portion 61 of the casing 6, (3) the unsolidified constituent resin of the sealing resin portion 7 has high viscosity, and (4) the distance between adjacent turns of the winding portions 2*a* and 2*b* is small, for example. Therefore, the constituent resin between the pair of winding portions 2*a* and 2*b* fills the casing 6 so as to rise from the lower side to the upper side of the casing 6, and air in the gap between the pair of winding portions 2*a* and 2*b* is unlikely to be caught in the resin, and it is possible to prevent bubbles from being formed in the sealing resin portion 7.

The upper surfaces of the winding portions in the reactor may be exposed to the outside from the sealing resin portion so that the heat dissipation properties of the reactor can be improved (see FIGS. 1, 5, and 7), for example. In such cases, if the upper surfaces of the end surface interposed members are flush with the upper surfaces of the winding portions or protrude further upward than the upper surfaces of the winding portions (if the end surface interposed members are not provided with upper cutouts), the constituent resin cannot flow into the gap between the pair of winding portions so as to cover the winding portions from a side surface side of the winding portions. In the reactor 1γ according to the fifth embodiment, the end surface interposed members 5γ are provided with the upper cutouts 59*a*, and the gap between the pair of winding portions 2*a* and 2*b* can be reliably filled with the constituent resin. This is because, even if the upper surfaces 2*u* of the winding portions 2*a* and 2*b* are exposed to the outside from the sealing resin portion 7, the constituent resin flows into the gap between the pair of winding portions 2*a* and 2*b* from end portions of the winding portions 2*a* and 2*b* upon the liquid level of the constituent resin filled in the gap between the casing 6 and the combined body 10 reaching the upper surfaces 32*u* of the outer core portions 32.

The invention claimed is:

1. A reactor comprising:

a coil that includes a winding portion;

a magnetic core that includes an inner core portion that is located inside the winding portion and an outer core portion that is located outside the winding portion;

an inner interposed member that is interposed between an inner surface of the winding portion and the inner core portion; and an end surface interposed member that is interposed between an end surface of the winding portion and the outer core portion, wherein an inner core portion-side inner end surface of the outer core portion is constituted by a flat surface that is not fitted to the end surface interposed member, the inner interposed member and the end surface interposed member are independent members, the inner interposed member is provided with first positioning portions that engage with the end surface interposed member and are located so as to respectively face a first pair of surfaces of the outer core portion to position the outer core portion, the first pair of surfaces being composed of a pair of surfaces that face each other.

2. The reactor according to claim 1, wherein the end surface interposed member is provided with second positioning portions that protrude toward the outer core portion and are located so as to respectively face a second pair of surfaces of the outer core portion to position the outer core portion, the second pair of surfaces being composed of a pair of surfaces that intersect the first pair of surfaces.

3. The reactor according to claim 2, wherein the second positioning portions include an L-shaped piece whose protruding end portion is bent, and that faces a surface of the outer core portion, the surface intersecting one of the second pair of surfaces of the outer core portion.

4. The reactor according to claim 1, wherein the end surface interposed member is provided with an abutting portion that protrudes toward the outer core portion and abuts against one of the first pair of surfaces.

5. The reactor according to claim 1, further comprising:

a casing that houses a combined body that includes the coil, the magnetic core, the inner interposed member, and the end surface interposed member; and a sealing resin portion that fills the casing and seals the combined body.

6. The reactor according to claim 5, wherein the magnetic core includes a plurality of core pieces and gap members that are interposed between the core pieces, and the gap members are formed using a constituent resin of the sealing resin portion.

7. The reactor according to claim 5, wherein the end surface interposed member is provided with a leg that protrudes toward a bottom surface of the casing to support the combined body and keeps a distance between the casing and the outer core portion.

8. The reactor according to claim 5, wherein the coil includes the winding portion that is provided as a pair of winding portions that are arranged side by side, and when an opening side of the casing that houses the combined body is defined as an upper side and a bottom surface side of the casing is defined as a lower side, the end surface interposed member is provided with an upper cutout that is located at an upper central position that corresponds to a gap between the pair of winding portions.

9. The reactor according to claim 8, wherein an uppermost surface of the end surface interposed member is flush with upper surfaces of the winding portions or protrudes further upward than the upper surfaces of the winding portions.

10. The reactor according to claim 8, wherein a lowermost surface of the upper cutout is flush with an upper surface of the outer core portion or is located at a position that is lower than the upper surface of the outer core portion.

11. The reactor according to claim 8, wherein the lowermost surface of the upper cutout includes a cutout inclined portion that is inclined downward in a direction from the outer core portion toward the winding portions.

12. The reactor according to claim 11, wherein the end surface interposed member is provided with a partition portion that is located between the pair of winding portions, and an upper surface of the partition portion includes a partition inclined portion that is continuous with the cutout inclined portion.

13. The reactor according to claim 5, wherein the end surface interposed member is provided with an inner cutout that serves as a flow channel for an unsolidified constituent resin of the sealing resin portion when the sealing resin portion is to be formed along an inner peripheral edge of the end surface interposed member.

* * * * *